US009067753B2

(12) United States Patent
Tokuma et al.

(10) Patent No.: US 9,067,753 B2
(45) Date of Patent: Jun. 30, 2015

(54) SHEET STACKING APPARATUS AND IMAGE FORMING APPARATUS

(71) Applicant: Canon Kabushiki Kaisha, Tokyo (JP)

(72) Inventors: Naoto Tokuma, Kashiwa (JP); Akito Sekigawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 13/804,075

(22) Filed: Mar. 14, 2013

(65) Prior Publication Data

US 2013/0285312 A1 Oct. 31, 2013

(30) Foreign Application Priority Data

Apr. 27, 2012 (JP) ..... 2012-102580
Mar. 13, 2013 (JP) ..... 2013-050303

(51) Int. Cl.
*B65H 31/34* (2006.01)
*B65H 31/10* (2006.01)

(52) U.S. Cl.
CPC ..... *B65H 31/34* (2013.01); *B65H 31/10* (2013.01); *B65H 2511/152* (2013.01); *B65H 2511/20* (2013.01); *B65H 2701/1315* (2013.01); *B65H 2801/06* (2013.01)

(58) Field of Classification Search
USPC ..... 270/58.12, 58.17, 58.27, 58.28, 58.16, 270/58.13, 58.11, 58.07; 271/226, 240, 271/248, 250
See application file for complete search history.

(56) References Cited

U.S. PATENT DOCUMENTS

| | | | | |
|---|---|---|---|---|
| 6,318,718 | B1 | 11/2001 | Ogata et al. | |
| 6,832,759 | B2 * | 12/2004 | Nagasako et al. | 271/222 |
| 6,871,851 | B2 | 3/2005 | Tamura et al. | |
| 6,973,285 | B2 | 12/2005 | Sekiyama et al. | |
| 7,300,052 | B2 | 11/2007 | Tamura et al. | |
| 7,451,980 | B2 * | 11/2008 | Tamura et al. | 271/220 |
| 8,251,362 | B2 * | 8/2012 | Konishi | 270/58.17 |
| 2002/0079642 | A1 | 6/2002 | Tamura et al. | |
| 2005/0189706 | A1 | 9/2005 | Tamura et al. | |
| 2012/0275839 | A1 | 11/2012 | Kushida et al. | |
| 2012/0288310 | A1 | 11/2012 | Kamiya et al. | |
| 2012/0313317 | A1 | 12/2012 | Gamo et al. | |
| 2012/0319346 | A1 | 12/2012 | Iwata et al. | |
| 2012/0326379 | A1 | 12/2012 | Sekigawa et al. | |

OTHER PUBLICATIONS

U.S. Appl. No. 13/856,589, filed Apr. 4, 2013, Applicant: Naoto Tokuma.

* cited by examiner

*Primary Examiner* — Leslie A Nicholson, III
(74) *Attorney, Agent, or Firm* — Fitzpatrick, Cella, Harper & Scinto

(57) ABSTRACT

In a finisher in which a sheet discharged by a pair of discharge rollers is stacked on a stack tray moveably provided in a sheet stack direction so that the position of a top surface of the sheet is constant and the sheet stacked on the stack tray is aligned by a pair of aligning members moveably provided in a width direction perpendicular to a discharge direction of the sheet, as a stack amount of the sheets stacked on the stack tray, which amount is detected by a stack amount detecting portion, is increased, the pair of aligning members upon the alignment are controlled to approach the top sheet stacked on the stack tray.

18 Claims, 16 Drawing Sheets

SHEET STACKING APPARATUS AND IMAGE FORMING APPARATUS

BACKGROUND OF THE INVENTION

1. Field of the Invention

The present invention relates to a sheet stacking apparatus which stacks and aligns sheets on a stack tray and an image forming apparatus including this sheet stacking apparatus.

2. Description of the Related Art

Conventionally, as a sheet stacking apparatus that stacks and aligns a sheet with an formed image on a stack tray, a configuration in which a discharged sheet is aligned by an aligning member in a width direction perpendicular to a discharge direction of the sheet as disclosed in U.S. Patent Application Publication No. 2002/0079642 A1.

In the sheet stacking apparatus as disclosed in U.S. Patent Application Publication No. 2002/0079642 A1, the sheet discharged to the stack tray by a discharge roller is returned upstream in the discharge direction on the stack tray by a return portion and abutted to an abutment member to be aligned in a conveyance direction. Thereafter, the aligning member is operated in the width direction perpendicular to the discharge direction to abut an end surface of the sheet in the width direction to align the sheet in the width direction. Such an aligning operation is repeated every time the sheet is discharged to the stack tray.

As the sheet is discharged and stacked in sequence, the stack tray is sequentially lowered so that the height of a top surface of the stacked sheets is maintained constant. At this time, the height of the top surface of the stacked sheets is detected by a sheet surface detection member abutting the top surface of the sheet in the discharge direction at a position that is more upstream than the position where the aligning member abuts the end surface of the sheets stacked in the width direction. By such an operation, the stacked sheets are prevented from being pushed out or jammed by interference between an upstream end of the stacked sheet in the discharge direction and a downstream end of the sheet to be discharged subsequently in the discharge direction.

In the sheet stacking apparatus disclosed in U.S. Patent Application Publication No. 2002/0079642 A1, in the initial stacking state where the sheet is not stacked on the stack tray, an amount of intrusion of a sheet abutting portion of the aligning member into a sheet stack surface of the stack tray (an overlapping amount of the aligning member overlapped with the sheet) is secured. The above-described overlapping amount as an initial value is secured if the shape of the top surface of the sheets (or a sheet bundle) stacked on the stack tray is parallel to the sheet stack surface on the stack tray beveled so that a downstream portion thereof in the discharge direction is higher.

However, since the downstream end of the sheet in the discharge direction firstly lands on the stack tray and then the upstream end of the sheet in the discharge direction lands on the stack tray when the sheet curved to be convex (hereinafter, referred to as downward curl) is stacked one by one, for example, an air layer is formed between the sheets at an upstream side in the discharge direction. Therefore, as the amount of the stacked sheets increases, the top surface of the sheet becomes substantially horizontal at the downward side in the discharge direction and becomes relatively lower than the upstream side in the discharge direction with respect to the sheet stack surface on the stack tray which is beveled so that the downstream portion thereof in the discharge direction is high. That is, as the amount of the stacked sheets increases, the height of the top surface of the sheet at a position at which the sheet surface detection member abuts the top surface of the sheet in the discharge direction becomes relatively higher than the height of the top surface of the sheet at a position at which the aligning member abuts the sheet in the discharge direction. In this case, at the position at which the aligning member abuts the sheet in the discharge direction to align the sheet, as the amount of the stacked sheets increases, the overlapping amount of the aligning member and the sheet is not secured so that the alignment of the sheet cannot be eventually performed to remarkably impair the aligning property of the sheet on the stack tray.

Further, when the sheet curved to be concave (hereinafter, referred to as upward curl) is stacked, a similar problem is also occurred since the top surface of the sheet warps upward with respect to the sheet stack surface of the stack tray.

SUMMARY OF THE INVENTION

Accordingly, it is desirable to reliably ensure that alignment of a sheet is performed using an aligning member even when the sheet stacked on a stack tray is curled to prevent the aligning property of the sheet from being reduced.

To address the above problems, the present invention provides an apparatus including: a discharge portion which discharges a sheet; a stacking portion including a stack tray on which the sheet discharged from the discharge portion is stacked and a sheet stack height detecting portion which detects a stack height of the sheets stacked on the stack tray, the stack tray being movably arranged in a sheet stack height direction so that a position of a top surface of the stacked sheets is maintained constant in accordance with a detection result obtained by the sheet stack height detecting portion; a pair of aligning members which is provided above the stack tray to be lifted and lowered in the sheet stack height direction and which moves in a width direction perpendicular to a discharge direction of the sheet to sandwich and align the sheet stacked on the stack tray at a downstream area from the sheet stack height detecting portion in the discharge direction; and a controller which controls positions of the pair of aligning members so that, when the stack amount of the sheets stacked on the stack tray is increased, the pair of aligning members are lowered to contact the sheet stacked on the stack tray at the time of alignment.

According to the present invention, when the stack amount of the sheets detected by the stack amount detecting portion is increased, the pair of aligning members are lowered to contact the sheet stacked on the stack tray at the time of alignment so that the sheet may be aligned by the pair of aligning members even if the sheet stacked on the stack tray is curled. Thereby, the alignment of the sheet is prevented from being reduced.

Further features of the present invention will become apparent from the following description of exemplary embodiments with reference to the attached drawings.

DESCRIPTION OF THE EMBODIMENTS

Hereinafter, exemplary embodiments of the present invention will be illustratively described with reference to the drawings. The size, material, shape, and relative positional relationship of component parts described in the following embodiments should be modified in accordance with the configuration of an apparatus according to the present invention and certain types of conditions. Accordingly, unless specifically described, the range of the present invention is not limited to only them.

A sheet stacking apparatus and an image forming apparatus including the sheet stacking apparatus according to the present embodiment are described with reference to FIGS. 1 to 19. The image forming apparatus according to the present embodiment is directed to an image forming apparatus such as a copying machine, a printer, a facsimile and a machine that combines them, which image forming machine including a sheet stacking apparatus that can align a sheet discharged to a stacking portion in a discharge direction. In the following embodiments, a description is made using a monochrome/color copying machine (hereinafter, referred to as "a copying machine") 1000 as an image forming apparatus.

Figure 1:
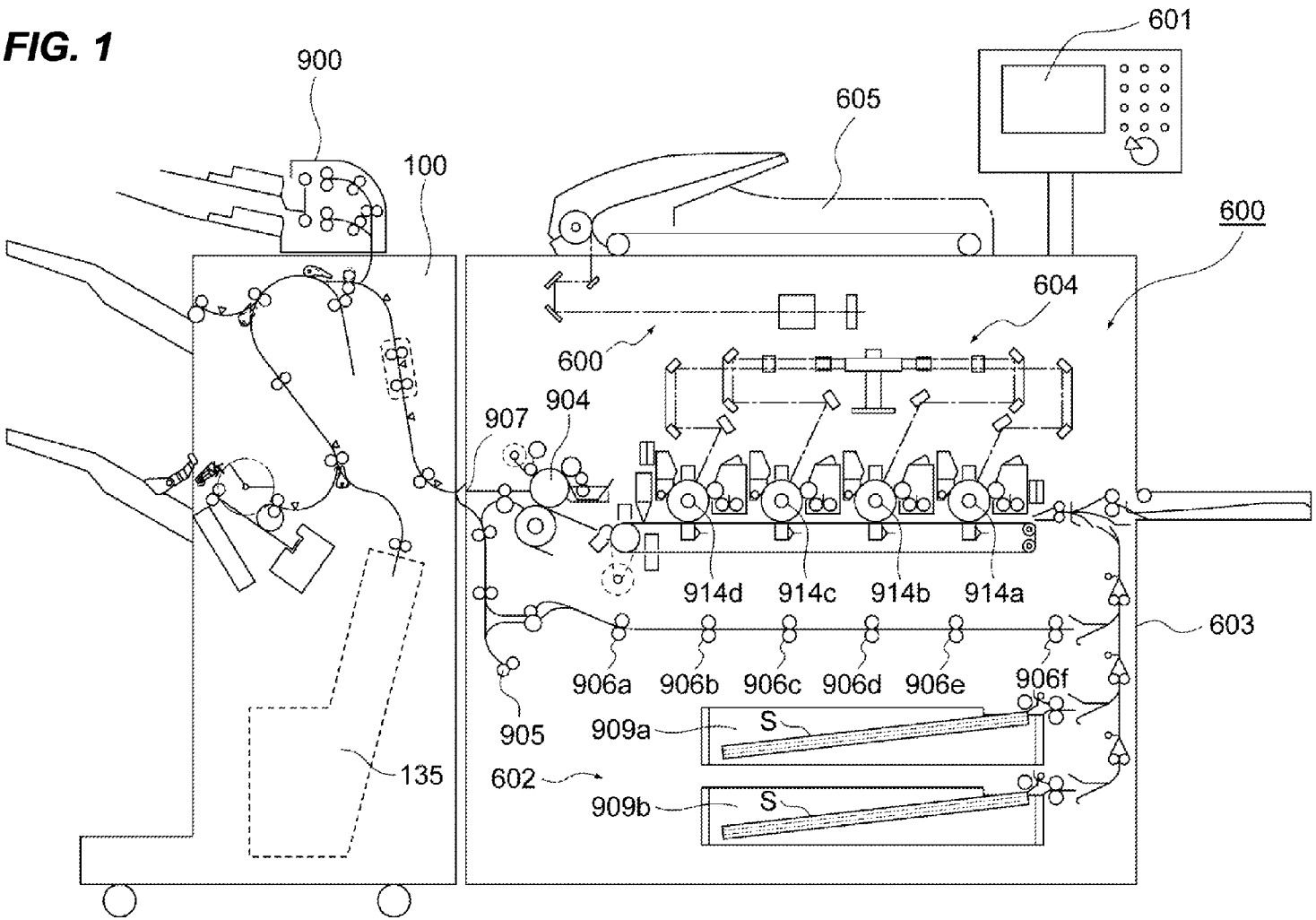
FIG. 1 is a cross-sectional view schematically illustrating a copying machine as an example of an image forming apparatus including a sheet stacking apparatus according to the present invention.
Figure 2:
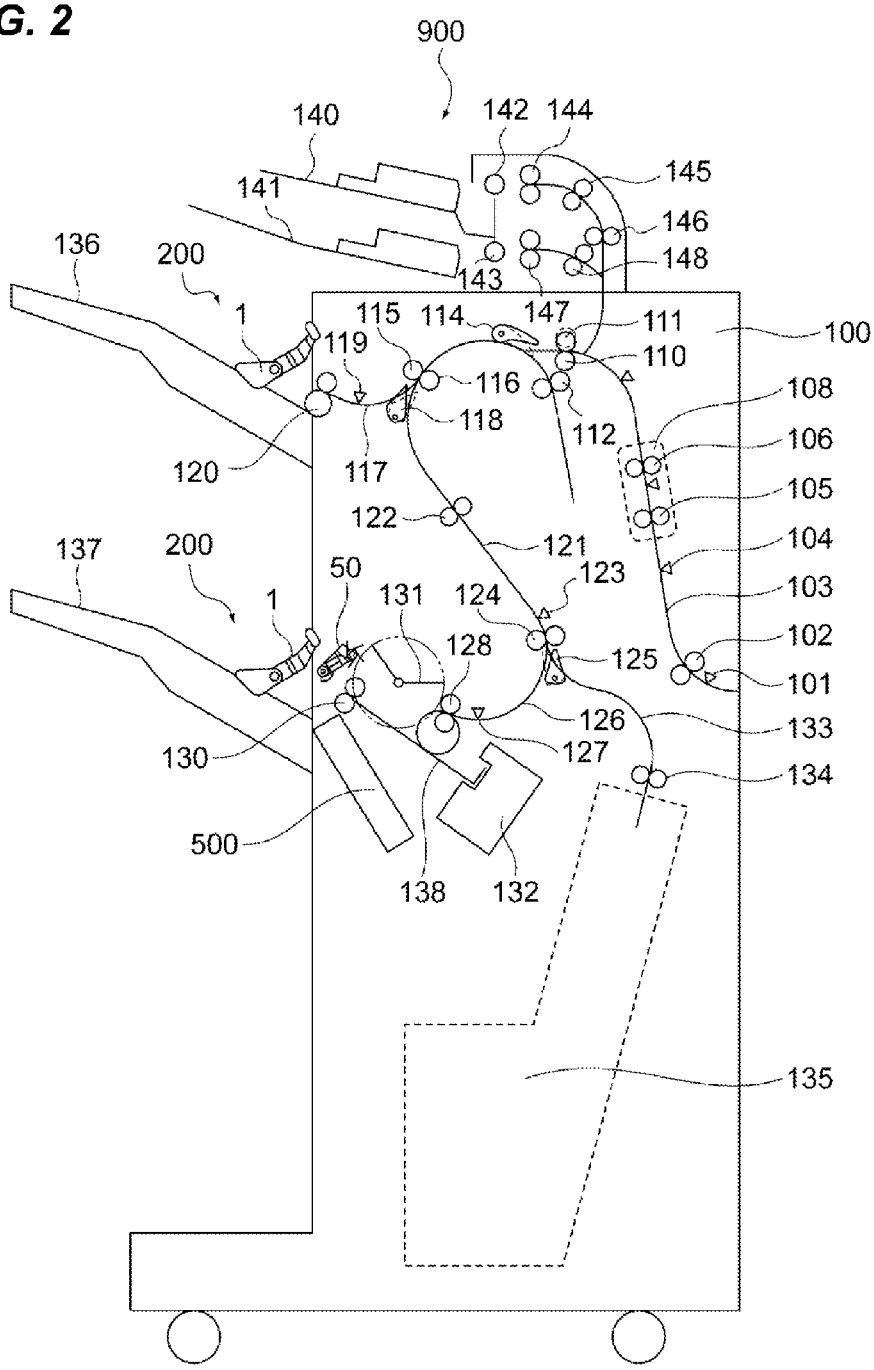
FIG. 2 is a cross-sectional view schematically illustrating a finisher as the sheet stacking apparatus according to the present invention.

First, an entire configuration of the copying machine 1000 according to the present embodiment is described with reference to FIGS. 1 and 2 according to a movement of a sheet S. FIG. 1 is a cross-sectional view schematically showing the copying machine 1000 according to an embodiment of the present invention. FIG. 2 is a cross-sectional view schematically showing a finisher 100 according to the present embodiment.

As illustrated in FIG. 1, the copying machine 1000 includes a copying machine body 600 as an image forming apparatus body for forming an image on the sheet S and the finisher 100 (sheet processing apparatus) as a sheet stacking apparatus. The finisher 100 according to the present embodiment is configured to be detachably attached to the copying machine body 600 and can be used as an option for the copying machine body 600 which can be independently used.

In the present embodiment, the explanation is made with the detachable finisher 100. The finisher and the copying machine body 600 may be integrated with each other. Hereinafter, a position where an operation portion 601 by which a user makes a various types of inputs/settings with respect to the copying machine 1000 is viewed is referred to as "front side" and a rear side of the machine is referred to as "back side". That is, FIG. 1 illustrates an inner structure of the copying machine 1000 viewed from the front side. The finisher 100 is connected to a lateral portion of the copying machine body 600.

The copying machine body 600 includes a sheet storage portion 602, a sheet feeding portion 603 which feeds the sheet S stored in the sheet storage portion 602, and an image forming portion 604 which forms an image on the sheet S fed by the sheet feeding portion 603. Further, the copying machine body 600 includes an original feeding device 605 which may feed an original and an image reader 606 which read out information of the original fed from the original feeding device 605.

The sheet storage portion 602 includes cassettes 909*a*, 909*b* which store the sheet S. The sheet S stored in the cassettes 909*a*, 909*b* is fed by the sheet feeding portion 603 to the image forming portion 604 at a certain timing. The image forming portion 604 has photosensitive drums 914*a* to 914*d* on which a toner image of each color of yellow, magenta, cyan and black is formed. The toner image of each color formed on the photosensitive drums 914*a* to 914*d* is transferred to the sheet S. Thereby, an unfixed toner image is formed on the sheet S. Thereafter, the unfixed toner image is fixed by a fixing device 904. The sheet S is discharged by a discharge roller 907 to the finisher 100.

In a case of duplex printing, after the sheet S is inversed by an inversing roller 905, the inversed sheet S is re-conveyed to the image forming portion 604 by conveying rollers 906*a*-906*f* provided in an inversing conveying path to repeat above-described processes. Further, in a case where information of the original is formed on the sheet S as image information, a toner image of the image information fed from the original feeding device 605 and read out by the image reader 606 is formed on each of the photosensitive drums 914*a*-914*d*, transferred to the sheet S, and then fixed thereon.

The finisher 100 is connected to a downstream side of the copying machine body 600 so as to introduce a plurality of sheets S supplied from the copying machine body 600 to perform saddle stitching process online. Further, on the finisher 100, an inserter 900 which can insert the sheet S in a conveying path in an inside of the finisher 100 is provided above a finisher body 400 as a device body. The inserter 900 is for inserting an insert sheet as a first page of a sheet bundle, a final page thereof or between the sheets on which images are formed at the copying machine body 600.

As illustrated in FIG. 2, the sheet S supplied from the copying machine body 600 is first transferred to a pair of inlet rollers 102 of the finisher 100. Upon the transfer, a timing of transferring the sheet S is detected at the same time by an inlet sensor 101. As for the sheet S delivered by the pair of inlet rollers 102, an end position of the sheet S is detected by a horizontal registration detection sensor 104 while the sheet S passes through a conveying path 103. The horizontal registration detection sensor 104 detects how much a horizontal registration error X of the sheet S is generated with respect to a center (central) position.

As the horizontal registration error X is detected by the horizontal registration detection sensor 104, the sheet S is operated to be shifted by moving a shift unit 108 by a certain amount in a front-back direction while the sheet S is delivered by a pair of shift rollers 105 and 106. The description of the horizontal registration detection process by the shift unit 108 is omitted here.

As the horizontal registration process by the shift unit 108 is completed, the sheet S is delivered by a pair of conveying rollers 110. The sheet S delivered by the pair of conveying rollers 110 is further delivered downstream by a pair of buffer rollers 115. Here, when the sheet S is discharged to an upper stack tray 136, an upper path switching member 118 is moved to a position illustrated by a dashed line in FIG. 2 by a driving portion such as a solenoid which is not shown. Thereby, the sheet S is guided to an upper path conveying path 117 to be discharged onto the upper stack tray 136 by a pair of upper discharge rollers 120.

On the other hand, when the sheet S is not discharged onto the upper stack tray 136, the upper path switching member 118 is moved to a position illustrated by a solid line in FIG. 2. Thereby, the sheet S is guided to a bundle conveying path 121 to be passed therethrough by a pair of buffer rollers 122 and a pair of bundle conveying rollers 124.

Next, when a binding process (a saddle stitch process) is performed on the sheet S, a saddle path switching member 125 is moved to a position illustrated by a dashed line in FIG. 2 by a driving portion such as a solenoid which is not shown. Thereby, the sheet S is delivered to a saddle path 133. The sheet S delivered to the saddle path 133 is guided to a saddle unit 135 by a pair of saddle inlet rollers 134 so that the binding process (the saddle stitch process) is performed on the sheet S. As for the binding process (the saddle stitch process), a description thereof is omitted here.

On the other hand, when the binding process (the saddle stitch process) is not performed, the saddle path switching member 125 is moved to a position illustrated by a solid line in FIG. 2. Thereby, the sheet S is delivered to the pair of bundle conveying rollers 124, and when the binding process is performed on the sheet S, the sheet S is delivered onto a processing tray 138 of a staple portion sequentially. After an aligning process in a sheet discharge direction and a width direction is performed on the sheet S delivered onto the processing tray 138, the binding process is performed on the sheet S by a stapler 132. As for a sheet process at the staple portion, a description thereof is omitted here.

The sheet S on which a certain sheet process is performed at the staple portion is discharged to a lower stack tray 137 as a stacking portion by a pair of bundle discharge rollers 130 as a discharge portion. When the binding process is not performed at the staple portion, the sheet S is, without passing through the processing tray 138, transferred from a pair of lower discharge rollers 128 to the pair of bundle discharge rollers 130 to be discharged to the lower stack tray 137. The sheet S discharged to the lower stack tray 137 is, thereafter, aligned in a sheet width direction and a discharge direction on the lower stack tray 137 by a width direction aligning portion 200 and a discharge direction aligning portion 300 which will be described below. As for an aligning process in the width direction by the width direction aligning portion 200 and an aligning process in the sheet discharge direction by the discharge direction aligning portion 300, the description thereof will be made in detail below.

Figure 3:
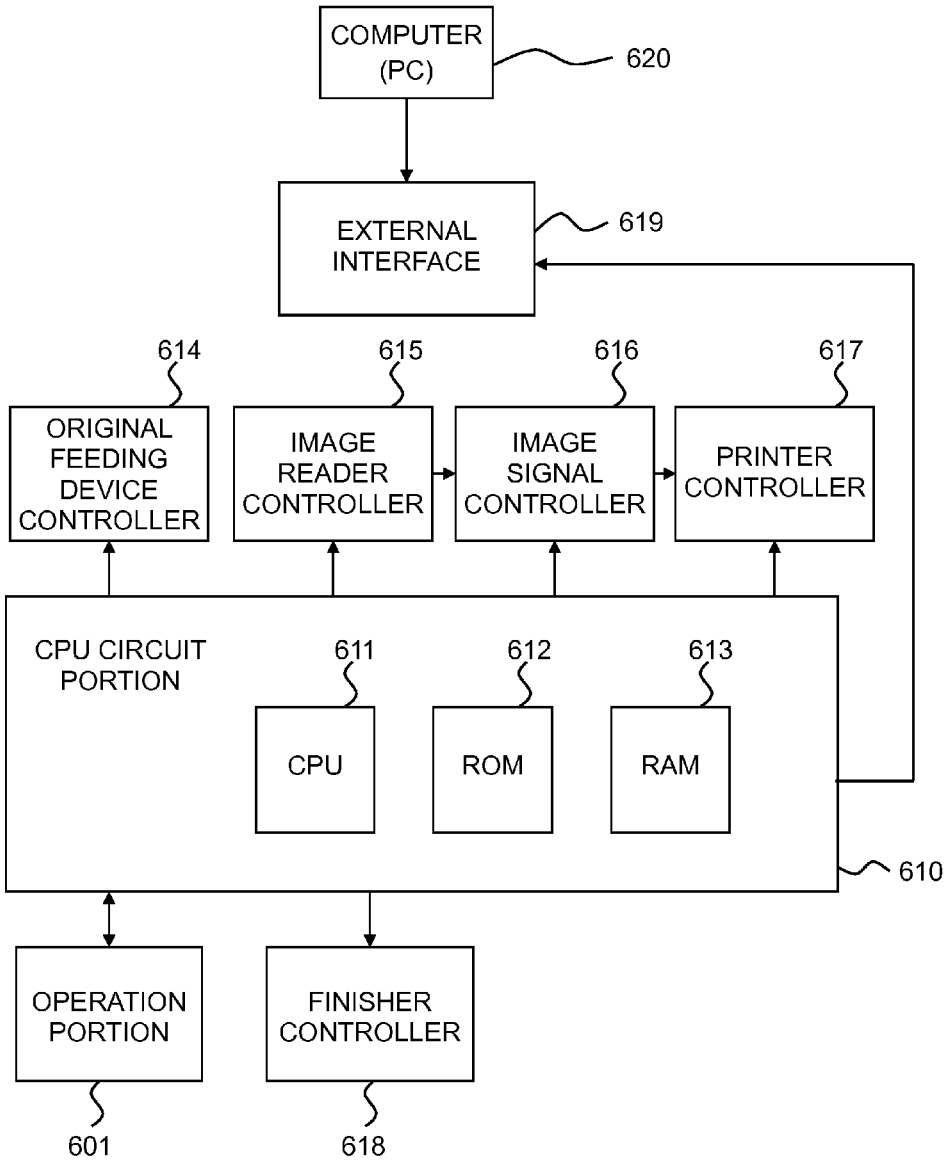
FIG. 3 is a block view illustrating a controller, which controls the copying machine according to the present invention.
Figure 4:
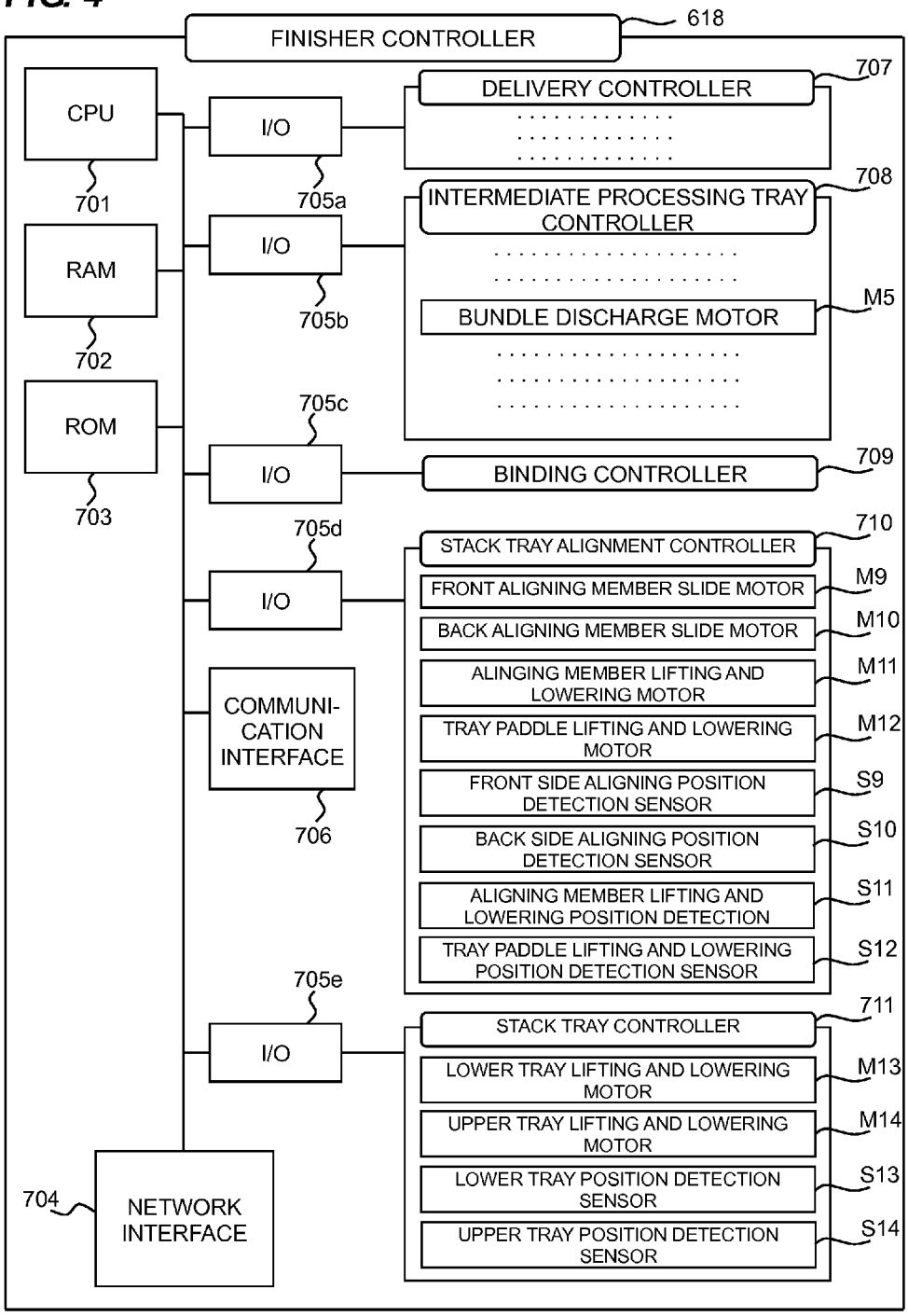
FIG. 4 is a block view illustrating a finisher controller according to the present invention.

Next, a CPU circuit portion 610 for controlling the copying machine 1000 according to the present embodiment is described with reference to FIGS. 3 and 4. FIG. 3 is a block view illustrating the CPU circuit portion 610 which controls the copying machine 1000 according to the present embodiment. FIG. 4 is a block view illustrating a finisher controller 618 according to the present embodiment.

As illustrated in FIG. 3, the CPU circuit portion 610 includes a CPU 611, a ROM 612 and a RAM 613. Further, the CPU circuit portion 610 is electrically connected to an original feeding device controller 614, an image reader controller 615, an image signal controller 616, a printer controller 617, and the finisher controller 618. The CPU 611 controls the original feeding device controller 614, the image reader controller 615, the image signal controller 616, the printer controller 617, and the finisher controller 618 according to a program stored in the ROM 612 and instruction information signals supplied from the operation portion 601. The RAM 613 is used as an area for temporarily storing control data or a working area for computation according to the control.

The original feeding device controller 614 controls the original feeding device 605 and the image reader controller 615 controls the image reader 606 for reading out information of the original fed from the original feeding device 605 (refer to FIG. 1). The data of the original read out by the image reader controller 615 is supplied to the image signal controller 616. The printer controller 617 controls the copying machine body 600. An external interface 619, which is an interface for connecting an external computer 620 and the copying machine body 600, develops print data supplied from the external computer 620 to an image to supply the image to the image signal controller 616. The image data supplied to the image signal controller 616 is supplied to a printer controller 617 so that the image forming portion 604 forms an image.

As illustrated in FIG. 4, the finisher controller 618 includes a CPU (microcomputer) 701, a RAM 702, a ROM 703, input output portions (I/O) 705*a* to 705*e*, a communication interface 706 and a network interface 704. Further, the finisher controller 618 includes a delivery controller 707, a processing tray controller 708, a binding controller 709, a stack tray alignment controller 710 and a stack tray controller 711.

Figure 5:
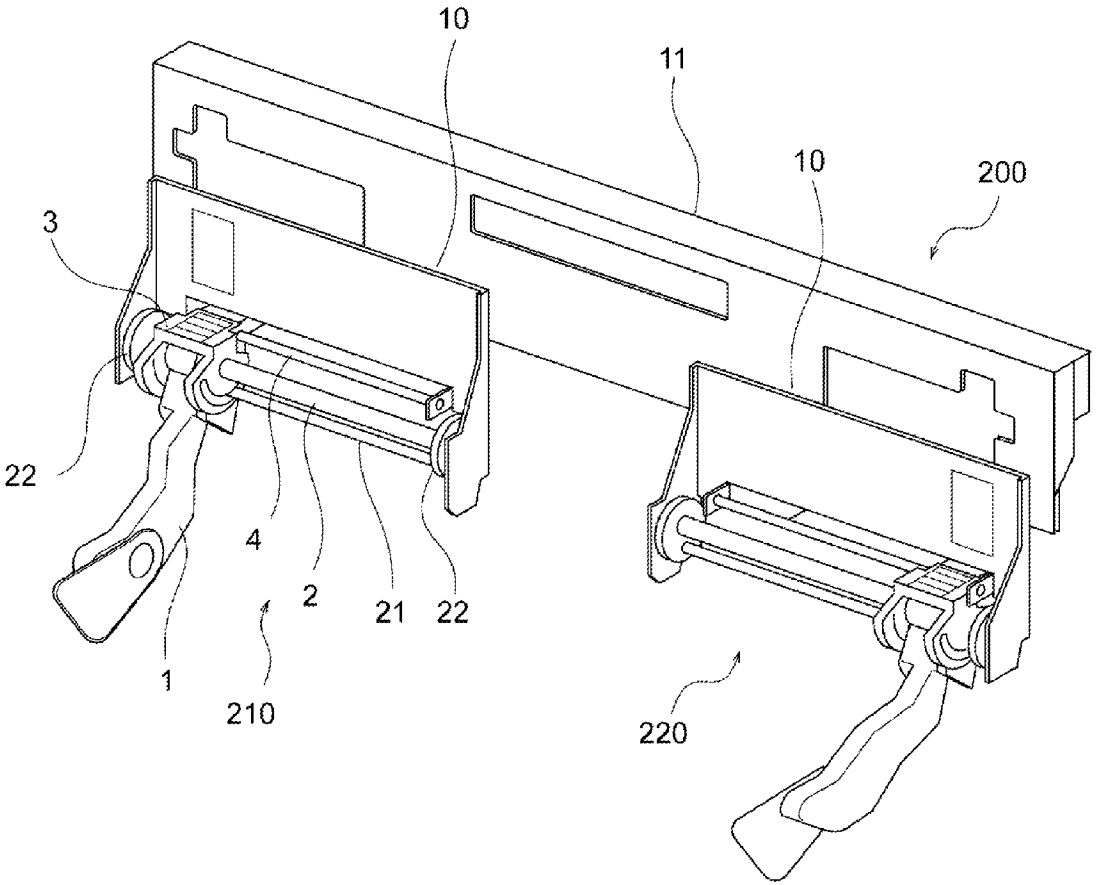
FIG. 5 is a perspective view illustrating a width direction aligning portion in the finisher.
Figure 6:
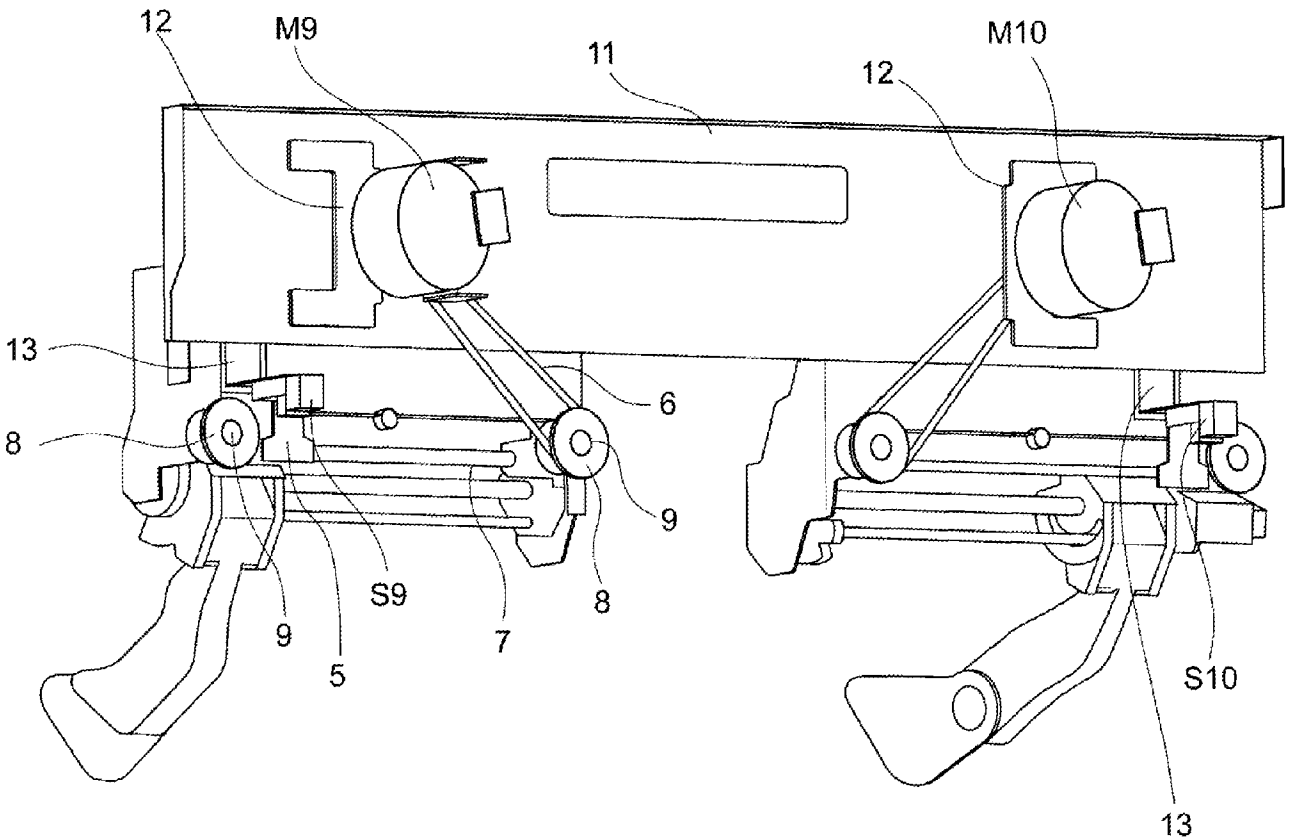
FIG. 6 is a perspective view illustrating the width direction aligning portion in the finisher.
Figure 7:
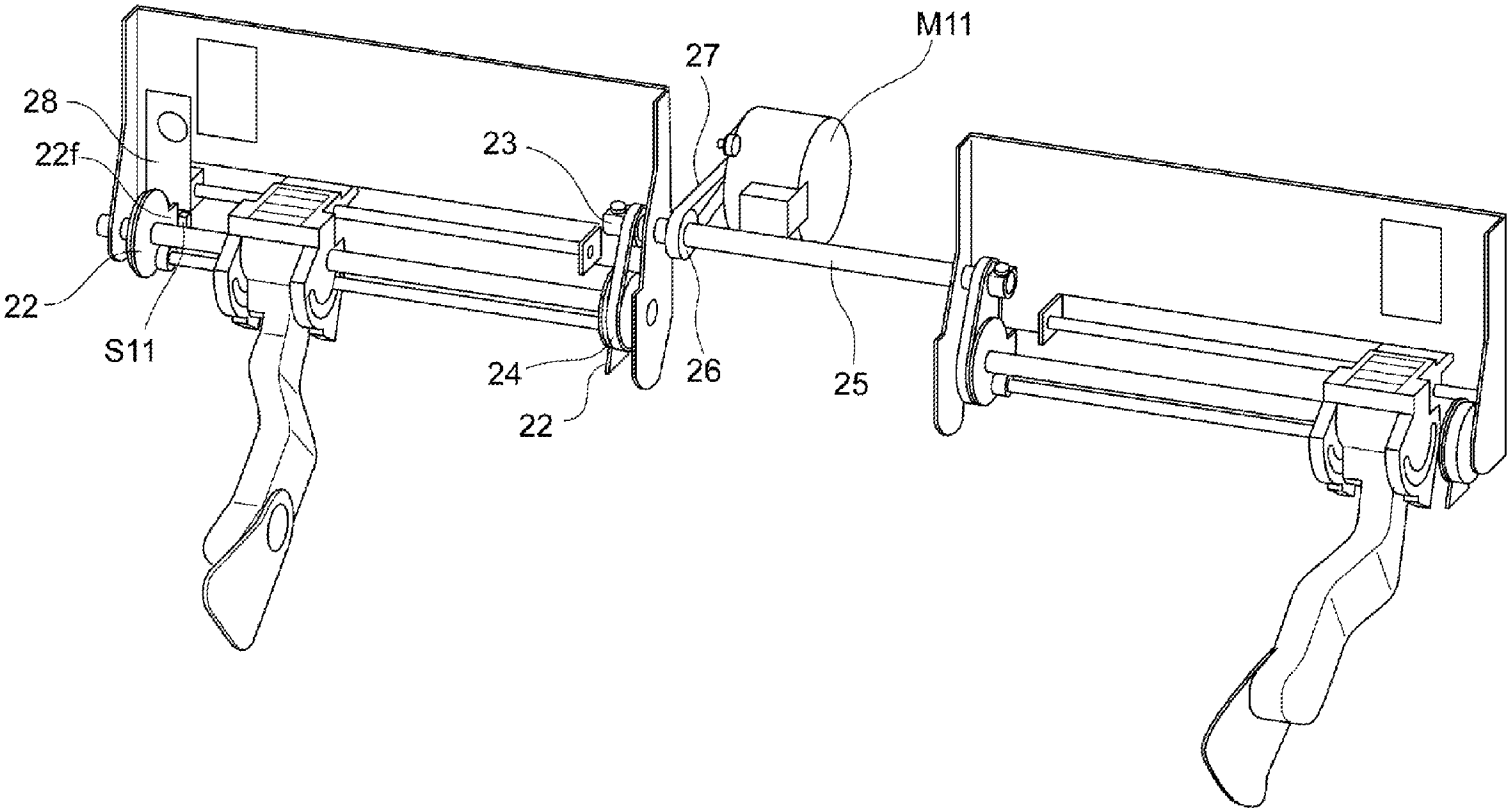
FIG. 7 is a perspective view illustrating the width direction aligning portion in the finisher.

Next, the width direction aligning portion 200 as a width direction aligning portion which performs an alignment in a width direction perpendicular to a discharge direction of the sheet discharged to the lower stack tray 137 is described with reference to FIGS. 5, 6 and 7 in addition to FIG. 2. FIGS. 5, 6 and 7 are perspective views illustrating the width direction aligning portion 200 in the finisher 100.

A pair of aligning members 1 in each of the width direction aligning portions 200 are moveably provided in a width direction perpendicular to a discharge direction of the sheet and contact an end of the sheet in the width direction stacked on the stack tray at a downstream area from a discharge direction of a sheet stack height detecting portion 510 which will be described below to sandwich the sheet to align it. Also, the pair of aligning members 1 are provided moveably (can be lifted and lowered) in a stack height direction of the sheet independent from the stack tray at an upper portion of the stack tray. This movement is controlled by the above-described finisher controller 618. The finisher controller 618 controls the pair of aligning members upon alignment to approach a top sheet stacked on the stack tray as an amount of the sheets stacked on the stack tray detected by the stack amount detecting portion increases. A description is made below.

As illustrated in FIG. 2, the width direction aligning portions 200 are provided above the lower stack tray 137 and above the upper stack tray 136 respectively. Since operations of the aligning portions 200 provided above the upper stack tray and the lower stack tray are the same with each other, the description of the aligning portion 200 of the lower stack tray is made. The description of the aligning portion 200 of the upper stack tray is omitted. As illustrated in FIGS. 5 to 7, the aligning portion 200 includes a front aligning unit 220 arranged on a front side, a back aligning unit arranged on a back side and an upper stay 11. The front aligning unit 220 and the back aligning unit 210 are symmetrically attached to the upper stay 11. Since the front aligning unit 220 and the back aligning unit 210 are of the same configuration, the configuration of the back aligning unit 210 is made here. The description of the front aligning unit 220 is omitted.

As illustrated in FIG. 5, the back aligning unit 210 includes the aligning member 1 which is shaped as an arm. The aligning member is pivoted by a first aligning support shaft 2 as a rotating center, and a proximal end thereof is supported by a sliding member 3 slidably supported by the first aligning support shaft 2. The sliding member 3 is configured to be moved in the front-back direction by being slid along the first aligning support shaft 2. The sliding member 3 is slidably supported by the first aligning support shaft 2 as the rotating center and also supported by a second aligning support shaft 4 as a rotating stopper.

Further, the sliding member 3, as illustrated in FIG. 6, nips a second slide driving transmission belt 7 with a slide position detecting member 5, and opposite ends of the second slide driving transmission belt 7 are hung by a slide driving transmission pulley 8. The slide driving transmission pulley 8 is rotatably supported by a pulley support shaft 9 swaged by a pulley support plate 10. Also, the slide driving transmission pulley 8 is formed as a stepped pulley to engage with a first slide driving transmission belt 6. The first slide driving transmission belt 6 engages with a back aligning member slide motor M10. The aligning member 1 is configured such that it moves in the front-back direction along the first aligning support shaft 2 by transmitting driving of the back aligning member slide motor M10 through the first slide driving transmission belt 6, the slide driving transmission pulleys 8, 8, the second slide driving transmission belt 7 and the sliding member 3. Detection of a slide position of the aligning member 1 is performed by the slide position detecting member 5 engaged with the sliding member 3, turning a back aligning position detecting sensor S ON/OFF.

Further, as illustrated in FIG. 5, the aligning member 1 engages with a third aligning support shaft 21, and opposite ends of the third aligning support shaft 21 are supported by aligning member lifting and lowering pulleys 22, which engage with the first aligning support shaft 2. Since the first aligning support shaft 2 engages with the aligning member lifting and lowering pulleys 22 by a parallel pin, rotations of the aligning member lifting and lowering pulleys 22 are synchronized with each other. Accordingly, as the aligning member lifting and lowering pulleys 22 rotates, the third aligning support shaft 21 also rotates about the first aligning support shaft 2 so as to lift and lower the aligning member 1 with which the third aligning support shaft 21 engages.

As illustrated in FIG. 7, the aligning member lifting and lowering pulleys 22 are coupled to a second lifting and lowering pulley 23 via a driving transmission belt 24. The front one of the second lifting and lowering pulleys 23 and the back one of the second lifting and lowering pulleys 23 are D-shaped and attached. Further, a third lifting and lowering pulley 26 engages with a lifting and lowering transmission shaft 25 and is coupled to an aligning member lifting and lowering motor M11 as an aligning member lifting and lowering portion via a driving transmission belt 27. Thereby, the driving of the aligning member lifting and lowering motor M11 is transmitted to the third lifting and lowering pulley 26 via the driving transmission belt 27 and to the aligning member lifting and lowering pulleys 22 via the lifting and lowering transmission shaft 25, the second lifting and lowering pulleys 23 and the driving transmission belt 24. Then, the aligning member lifting and lowering pulleys 22 are rotated to lift and lower the aligning member 1 via the third aligning support shaft 21.

Upon such an operation, as illustrated in FIG. 7, flag portions 22*f* that the aligning member lifting and lowering pulleys 22 have turns an aligning member position detection sensor S11, which detects the position of the lifted and lowered aligning member 1, ON/OFF to detect the position of the lifted and lowered aligning member 1. Then, the stack tray alignment controller 710 (refer to FIG. 4) of the finisher controller 618 controls to adjust the position of the aligning member 1.

As described above, the driving of the aligning member lifting and lowering motor M11 is transmitted to lift and lower the pair of the aligning members 1 of the front aligning unit 220 and the back aligning unit 210 so that the lifting and lowering (rotations) of the pair of the aligning member 1 of the front aligning unit 220 and the back aligning unit 210 are synchronized with each other for rotation to adjust the positions thereof.

Figure 8:
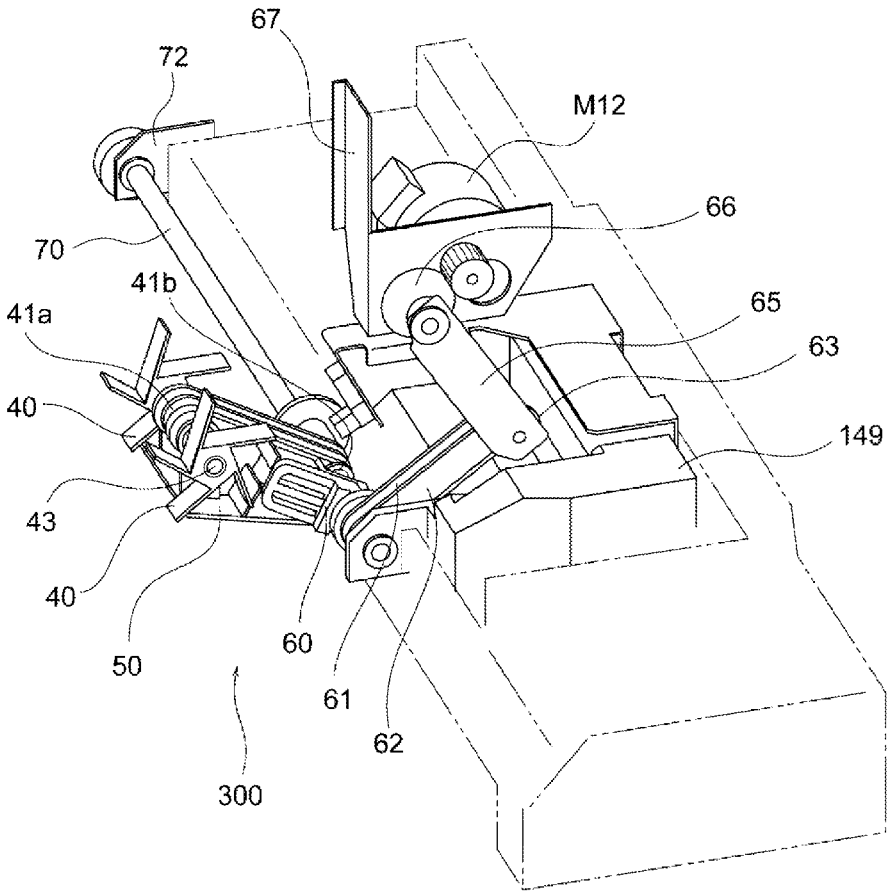
FIG. 8 is a perspective view illustrating a discharge direction aligning portion supported by an upper open and close guide.
Figure 9:
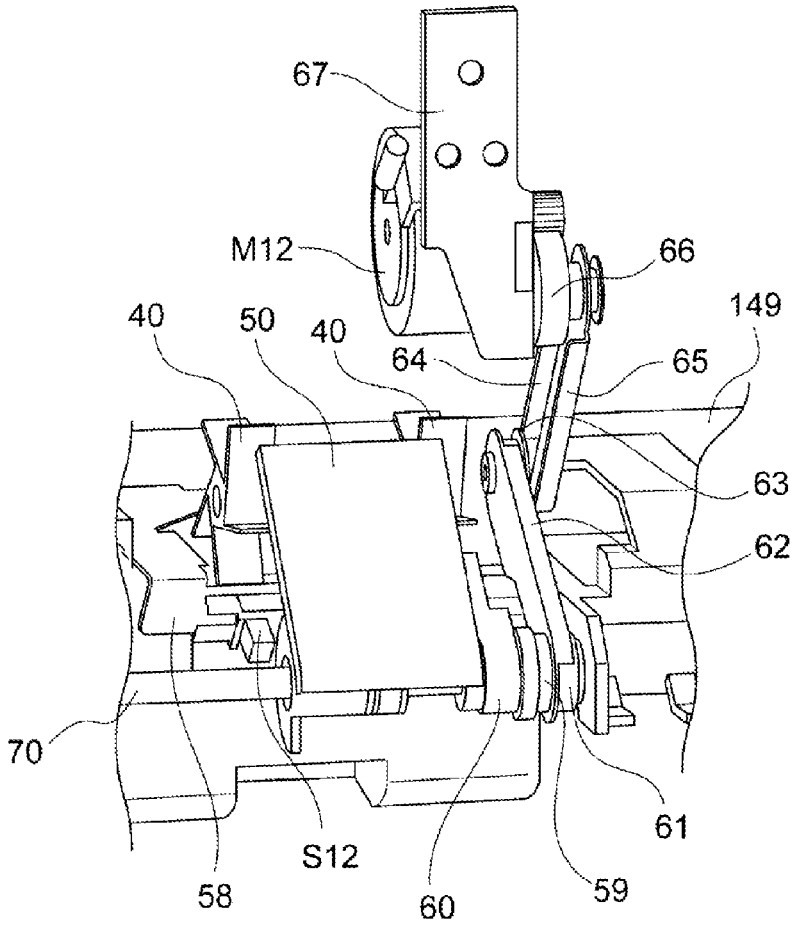
FIG. 9 is a perspective view illustrating the discharge direction aligning portion supported by the upper open and close guide.
Figure 10:
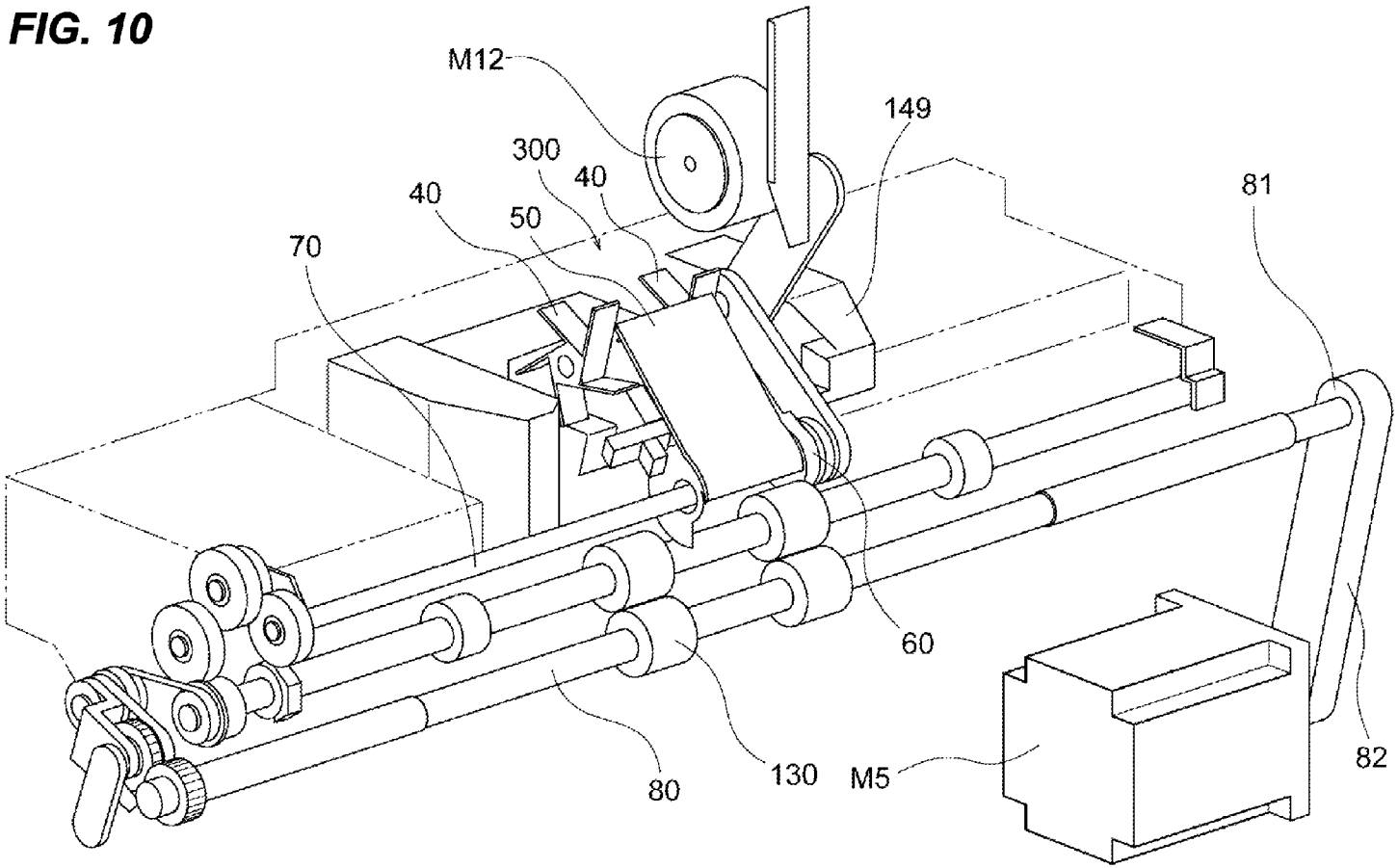
FIG. 10 is a perspective view illustrating the discharge direction aligning portion connected to a bundle discharge motor.

Next, a discharge direction aligning portion 300, which aligns the sheet discharged to the lower stack tray 137 in the sheet discharge direction, will be described with reference to FIG. 6. FIGS. 8 and 9 are perspective views illustrating the discharge direction aligning portion 300 supported by an upper open and close guide 149. FIG. 10 is a perspective view illustrating the discharge direction aligning portion 300 connected to a bundle discharge motor M5.

As illustrated in FIG. 10, the discharge direction aligning portion 300 is configured to be supported by substantially a central portion of the upper open and close guide 149 in the front-back direction over the pair of bundle discharge rollers 130 to be positioned over a sheet P discharged from the processing tray 138. The discharge direction aligning portion 300 includes tray paddles 40 as a rotating member of an abutment portion and a return holder 50 as a rotating lever. The tray paddles 40 are rotatably supported by a distal end of the return holder 50 and a proximal end of the return holder 50 is supported by a tray return support shaft 70. A front side of the tray return support shaft 70 is rotatably supported by an upper open and close guide 149 to be positioned over the pair of bundle discharge rollers 130. Another end (back side) of the tray return support shaft 70 is supported by the upper open and close guide 149 via a gear support plate 72 (refer to FIG. 8).

As illustrated in FIG. 9, a return member lifting and lowering pulley 60 is also supported by the tray return support shaft 70 to engage with the return holder 50. That is, the rotation of the return member lifting and lowering pulley 60 is synchronized with rotation (lifting and lowering) of the return holder 50. A driving transmission belt 61 and a first lifting and lowering link 62 are connected to the return member lifting and lowering pulley 60 via a lifting and lowering pulley spacer 59 and the driving transmission belt 61 and the first lifting and lowering link 62 are connected to a lifting and lowering link pulley 63. The lifting and lowering link pulley 63 is connected to a tray paddle lifting and lowering motor M12 via a driving transmission belt 64 and a lifting and lowering gear 66. A second lifting and lowering link 65 is attached to the driving transmission belt 64 to maintain a space between shafts of the driving transmission belt 64. The tray paddle lifting and lowering motor M12 is attached to a lifting and lowering motor support plate 67 and the lifting and lowering motor support plate 67 is attached to the upper stay 11. As configured above, driving force of the tray paddle lifting and lowering motor M12 is transmitted to the lifting and lowering gear 66, the driving transmission belt 64, the lifting and lowering link pulley 63, the driving transmission belt 61 and the return member lifting and lowering pulley 60 so that the return holder 50 can rotate (be lifted and lowered) about the tray return support shaft 70. That is, the tray paddles 40 supported by the distal end of the return holder 50 can be lifted and lowered.

The rotation of the return holder 50 is detected and controlled by shutting a flag portion of the return holder 50 by a tray paddle lifting and lowering position detection sensor S12 attached to the upper open and close guide 149 via a sensor plate 58. Specifically, the return holder 50 is controlled to be moved between a position at which the return holder 50 awaits over the pair of bundle discharge rollers 130 and an abutment position at which the return holder 50 forces the sheet on the lower stack tray 137 to abut an abutment portion 170. Further, the return holder 50 is accommodated in the upper open and close guide 149 after jobs.

The tray paddles 40 are formed by radially fixing a plurality of paddles about a rotation shaft. As illustrated in FIG. 8, the tray paddles 40 engage with and are rotatably supported by the proximal end of the return holder 50 together with a tray return shaft 43. The tray return shaft 43 engages with a tray return pulley 41*a* via a parallel pin and a tray return pulley 41*b* engages with the tray return support shaft 70 via a parallel pin. Rotation of the tray return support shaft 70 is, as illustrated in FIG. 10, associated with driving of the pair of bundle discharge rollers 130 on a back side of the upper open and close guide 149. That is, the tray return support shaft 70 is driven by the bundle discharge motor M5 as well as the pair of bundle discharge rollers 130. As described above, driving of the bundle discharge motor M5 is transmitted to the tray paddles 40 via the tray return support shaft 70 and the like.

Next, lifting and lowering operation and control of the lower stack tray 137 will be described with reference to FIGS. 11 and 12.

Figure 11:
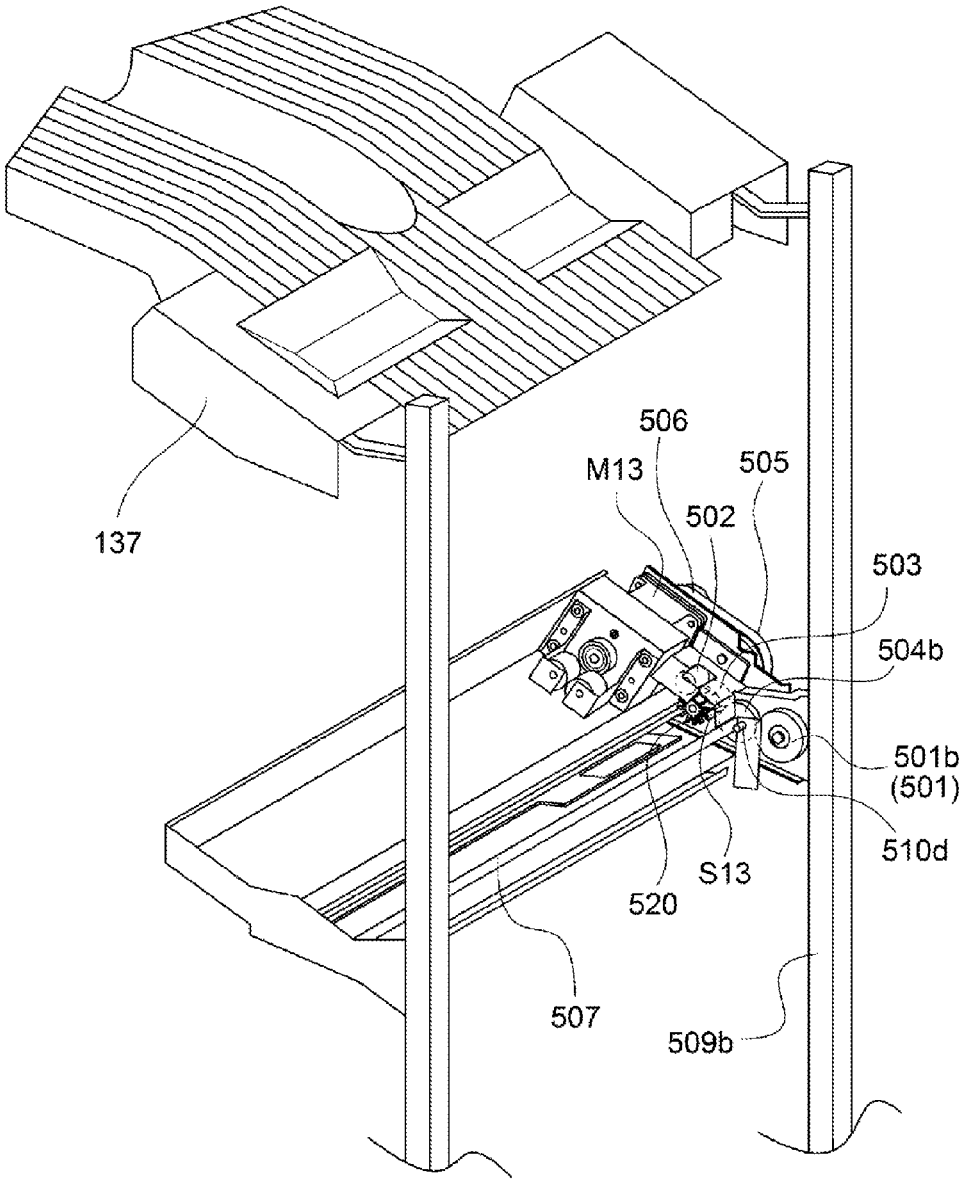
FIG. 11 is a perspective view selectively illustrating only a lower stack tray unit and a rack portion.

FIG. 11 is a perspective view selectively illustrating a lower stack tray unit and a rack portion only. FIG. 11 is also an exploded view illustrating the lower stack tray 137 separated from the lower stack tray unit and a view illustrating a back side driving portion thereof. FIG. 12 is a view illustrating a sheet stack height detecting portion downstream the sheet conveyance direction viewed from the pair of bundle discharge rollers 130.

The lower stack tray 137 is lifted and lowered by pinion gears 501 running on racks 509. The pinion gears 501 are embedded in the unit. That is, the lower stack tray 137 is moveably provided in the sheet stack height direction (a vertical up-and-down direction). As illustrated in FIG. 11, driving of a tray lifting and lowering motor M13 as a tray lifting and lowering portion is transmitted to the pinion gears 501 via a first lifting and lowering gear 502, a second lifting and lowering gear 503, third lifting and lowering gears 504, a lifting and lowering pulley 505 and a lifting and lowering belt 506. The pinion gears 501 and the racks 509 are provided on a front side and a back side. Driving of a third lifting and lowering gear 504*a* of the third lifting and lowering gears 504 on the front side is transmitted to the pinion gear (not shown) on the front side and driving of a third lifting and lowering gear 504*b* of the third lifting and lowering gears 504 on the back side is transmitted to a pinion gear 501*b* of the pinion gears 501 on the back side. Since the third lifting and lowering gears 504 on the front side and the back side engage with a lifting and lowering shaft 507 via a parallel pin, driving of the pinion gear 501 on the front side and driving of the pinion gear 501 on the back side are synchronized with each other. Accordingly, the two pinion gears 501 run on the two racks 509 to lift and lower the lower stack tray 137.

The position of the lower stack tray 137 is controlled by detecting a sheet stack surface and a top surface of a sheet bundle by the sheet stack height detecting portion 510. The lower stack tray 137 is lifted and lowered in the sheet stack height direction so that the position of the top surface of the sheet is constant in accordance with a detection result by the sheet stack height detecting portion 510.

Figure 12:
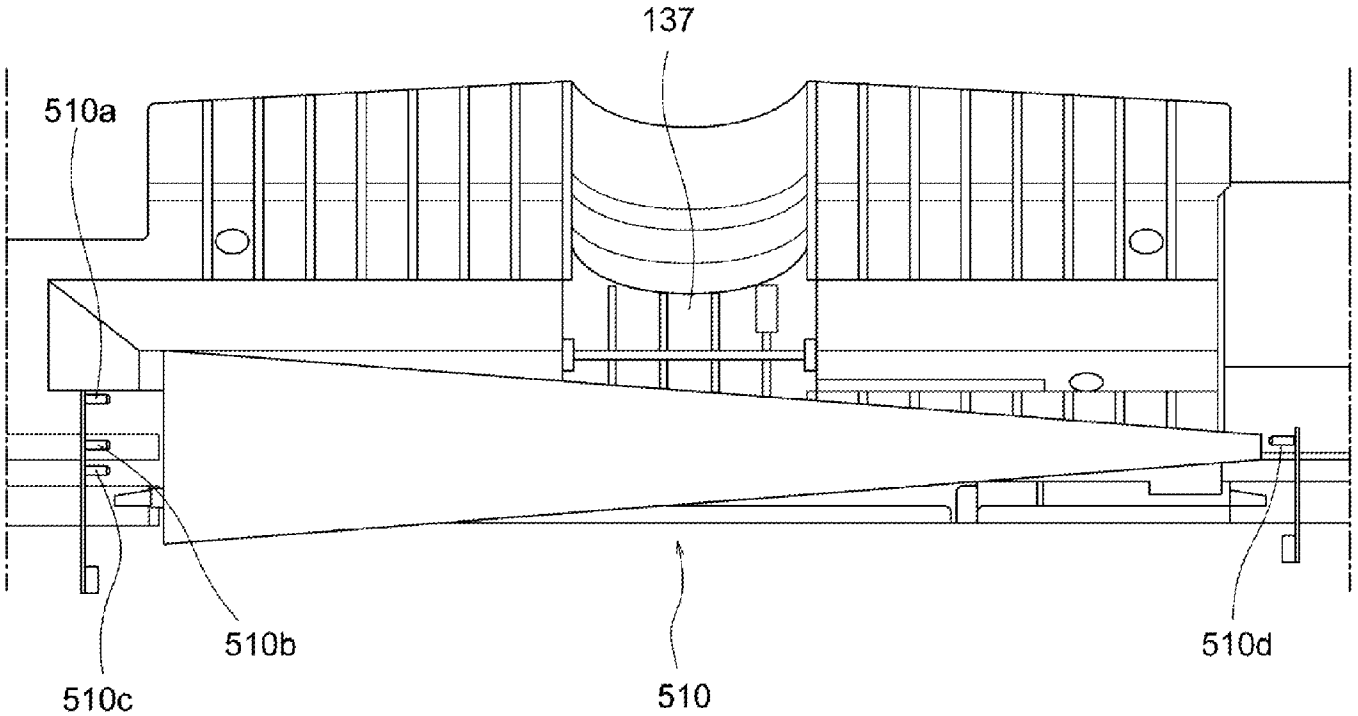
FIG. 12 is a view in which a sheet stack height detecting portion of the lower stack tray unit downstream sheet conveyance direction is viewed from a bundle discharge roller.

As illustrated in FIG. 12, the sheet stack height detecting portion 510 is provided to abut an upstream end of the sheet stacked on the lower stack tray 137 to detect the position of the top surface of the sheet. Also, the sheet stack height detecting portion 510 includes a first detector 510*a*, a second detector 510*b*, a third detector 510*c* and a light emission member 510*d* which emits light on the respective detectors 510*a* to 510*c*. The light is emitted by the light emission member 510*d* and the sheet stack height detecting portion 510 detects ON/OFF by determining whether or not the respective detectors 510*a* to 510*c* receive the light. Prior to a start of a job (no sheet on the stack tray), only the third detector 510*c* is shaded by the lower stack tray 137 to be turned ON. Thereafter, as the sheet is stacked on the lower stack tray 137 sequentially, the second detector 510*b* is shaded by the sheet to be turned ON. As the second detector 510*b* is turned ON, the tray lifting and lowering motor M13 is driven to lower the lower stack tray 137 until the second detector 510*b* is turned OFF. As described above, by repeating operations in which the sheet is stacked, the second detector 510*b* is turned ON, the tray is lowered and the second detector 510*b* is turned OFF, the sheet is stacked on the lower stack tray 137 sequentially.

Also, as illustrated in FIG. 11, an encoder 520 is attached onto a shaft of the second lifting and lowering gear 503 which is engaged with the first lifting and lowering gear 502. A tray position detection sensor S13 as a movement amount detection portion detects whether the encoder 520 is turned ON/OFF to detect a rotation amount of the lower tray lifting and lowering motor M13, namely an amount (amount of movement in the sheet stack height direction) of lowering of the lower stack tray 137. Thereby, how much the lower stack tray 137 is lowered from an initial position upon starting the job is detected. Also, the encoder 520 and the lower tray position detection sensor S13 may configure a stack amount detection portion which detects the amount (amount of the movement) of lowering of the lower stack tray 137 lowered accompanying an increase of the amount of the stack tray as the stack amount of the sheets to maintain the position of the top surface of the sheet constant.

Figure 16:
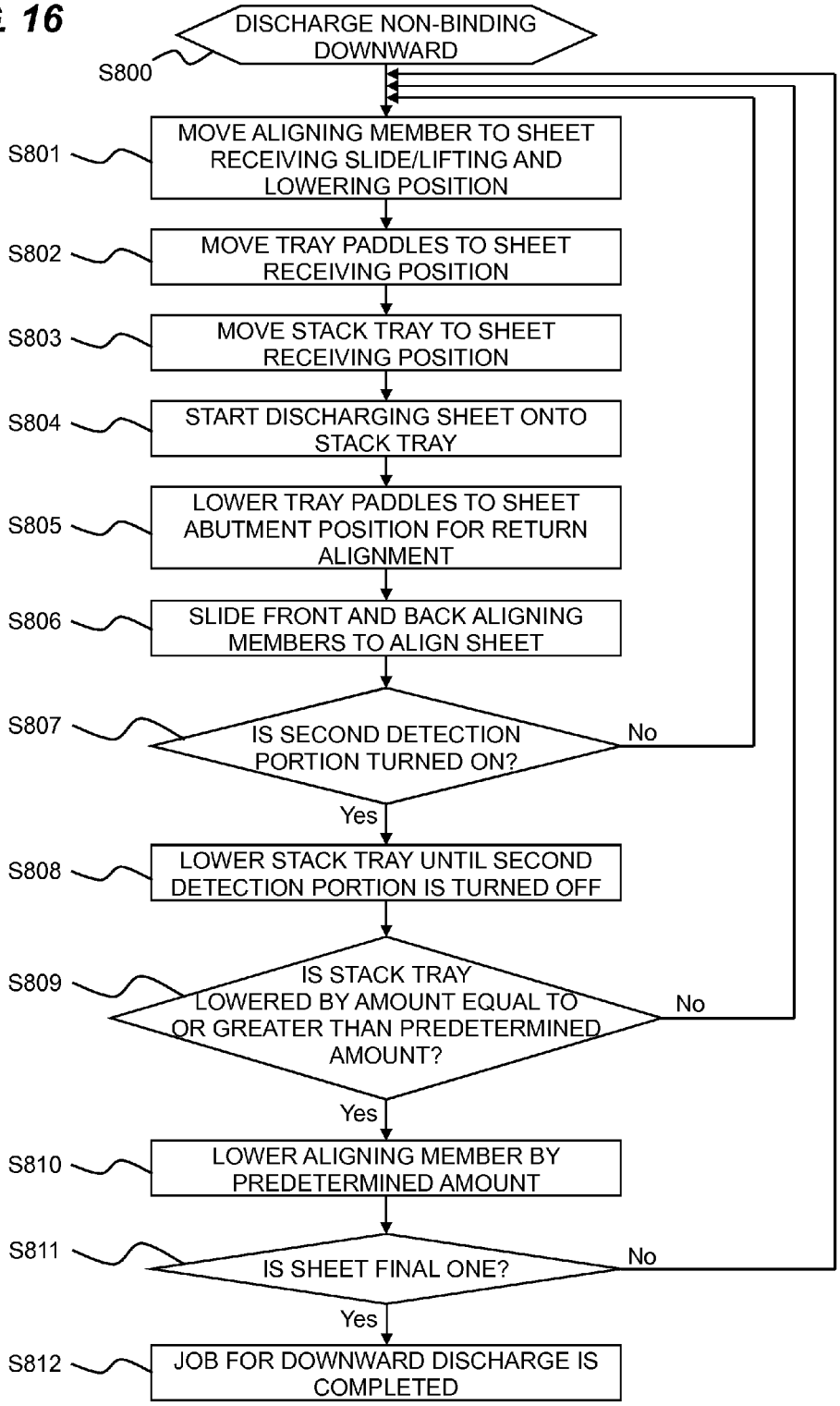
FIG. 16 is a flowchart illustrating flows of stacking operation of the sheet to a stack tray unit.

Next, based on the above-described configurations, with respect to stacking of the sheet onto the stack tray according to the present embodiment, operations of the respective portions will be described according to flow of the sheet with reference to FIGS. 13A, 13B, 13C, 14A, 14B and a flowchart of FIG. 16.

When a non-binding lower discharge stack mode is set by a user and the job is started (S800), the pair of the aligning members 1, the lower stack tray 137 and the tray paddles 40 are operated to perform initial operations and moved to home positions thereof. A back side aligning position detection sensor S10 provided on the back side and a front side aligning position detection sensor S9 (refer to FIG. 6) detect home positions of sliding positions of the pair of aligning members 1 to move the pair of aligning members 1 to the home positions in the sheet width direction. Aligning member lifting and lowering position detection sensors S11 (refer to FIG. 7) detect home positions of lifting and lowering positions of the pair of aligning members 1 to move the pair of aligning members 1 to the home positions in the sheet stack height direction. The tray paddles 40 are moved to the home positions by the tray paddle lifting and lowering position detection sensor S12 as well. Further, by driving the lower tray lifting and lowering motor M13, the lower stack tray 137 is also moved to a position at which only the third detector 510*c* of the sheet stack height detecting portion 510 is shaded by the lower stack tray 137 to be turned ON. Thereby, the detection of the home positions of the respective members is completed. According to the above-described initial operations, the lower stack tray 137 and the tray paddles 40 are moved to the home positions to be in a state illustrated in FIG. 13A.

Next, after completion of the initial operations, the pair of aligning members 1 and the tray paddles 40 are moved to a sheet receiving position. First, the pair of the aligning members 1 is slid to the sheet receiving position in accordance with information on the sheet size. The sheet receiving position is directed to a positional relationship in which space between the aligning members 1 is set larger than a length in a depth direction of the sheet by a predetermined amount to avoid jamming the sheet to be discharged. Here, the length in the depth direction of the sheet corresponds to the length in the width direction (the front-back direction of the apparatus) perpendicular to the discharge direction of the sheet. Thereafter, the pair of aligning members 1 that are retracted from a sheet passing surface to an upper shelter position by the initial operations are lowered by an aligning member lifting and lowering mechanism by a predetermined amount to be moved to the sheet receiving position (S801). The tray paddles 40 are also moved to the sheet receiving position shown in FIG. 13B (S802). As for the lower stack tray 137, since the home position thereof corresponds to the sheet receiving position, preparation for receiving the sheet is completed (S803). As the above-described movement to the sheet receiving position is completed, the pair of aligning members 1 and the tray paddles 40 are in a state illustrated in FIG. 13B.

Figure 13A:
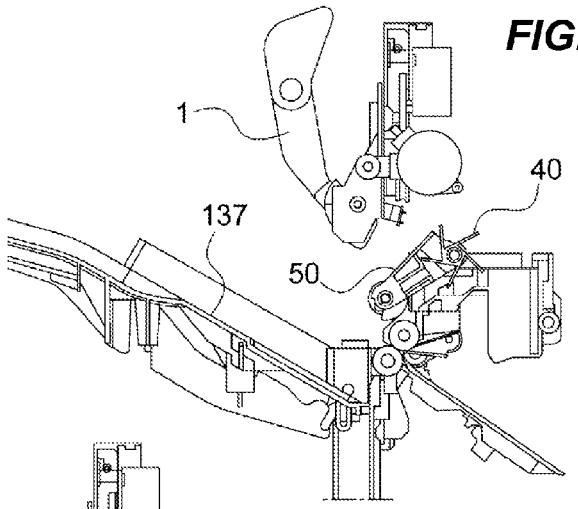
FIGS. 13A, 13B and 13C are lateral views of main portion illustrating operations of the aligning member and a tray paddle in the lower stack tray unit.
Figure 13B:
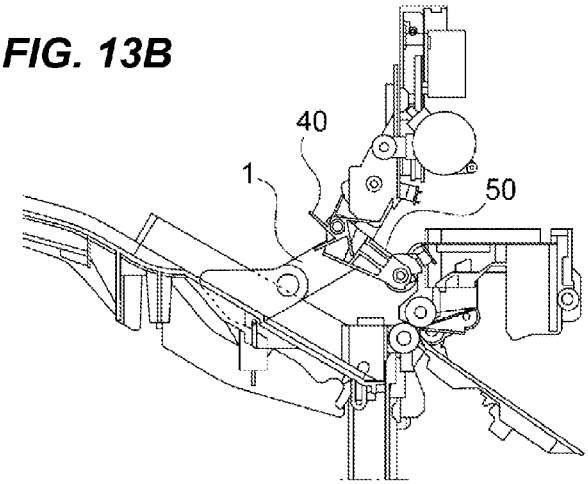
Figure 13C:
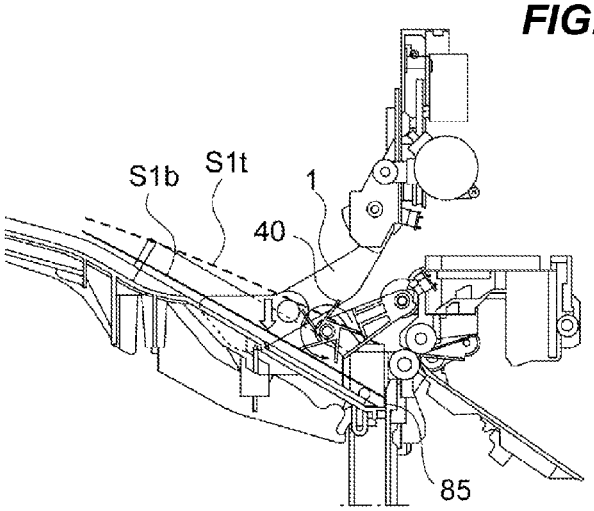

Then, the sheet on which pages are imposed and image is formed accordingly is sequentially discharged from the discharge roller 907 of the printer portion 600. After the sheet is transferred to the pair of inlet rollers 102 of the finisher 100, the sheet passes through the conveying path 103 and enters the bundle conveying path 121. Thereafter, the sheet is conveyed to a lower path 126 by the switching member 125 in the middle of the bundle conveying path 121. The sheet is further conveyed through the pair of lower discharge rollers 128, the pair of bundle discharge rollers 130 and to the lower stack tray 137 (S804). Then, after a back end of the conveyed sheet passes through a nip between the pair of bundle discharge rollers 130, the tray paddles 40 are lowered by a predetermined amount to drop the discharged sheet S as illustrated in FIG. 13C. At the same time, the tray paddles 40 are rotated so that the sheet S abuts an abutment member 85 on the tray to be aligned in the conveyance direction (S805). Timing in which the back end of the sheet is passed through the nip between the pair of bundle discharge rollers 130 to be dropped by the tray paddles 40 is controlled by a way such that the sheet is dropped after a predetermined time when the back end of the sheet passes through a lower discharge sensor 127 (refer to FIG. 2). After the tray paddles 40 stop at a lowered position (a position illustrated in FIG. 13C), the tray paddles 40 are lifted to the sheet receiving position (a position shown in FIG. 13B).

Figure 14A:
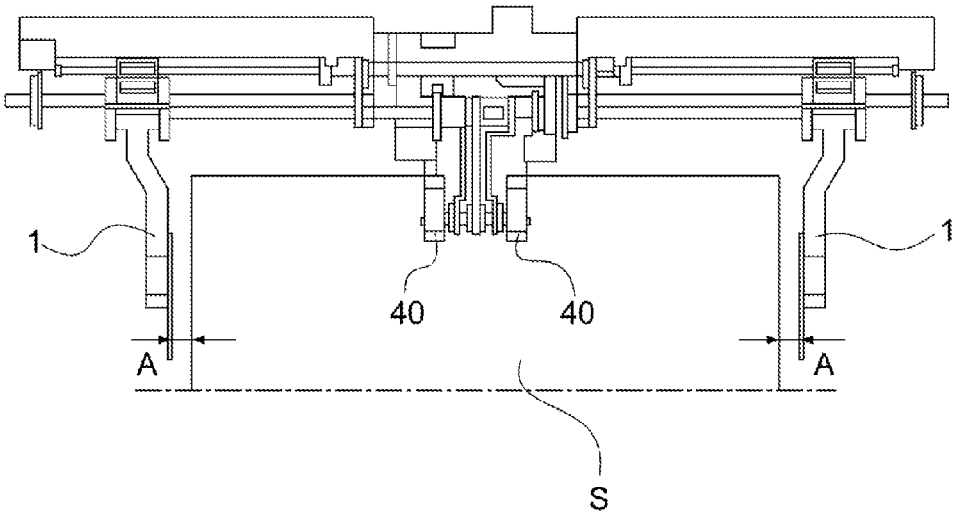
FIGS. 14A and 14B are partial top views illustrating a relationship between a sheet discharged to a stack tray and the aligning member.
Figure 14B:
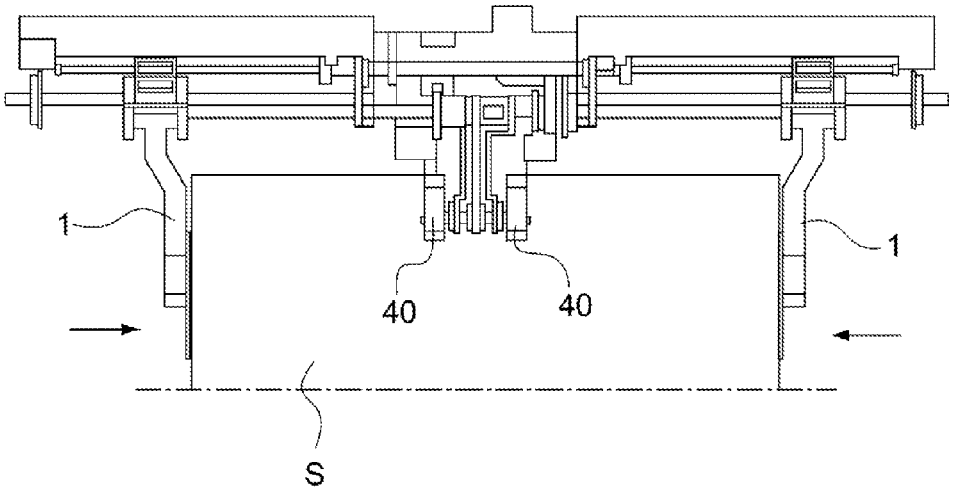

Next, as illustrated in FIG. 14A, after the sheet lands on the stack tray, the sheet is sandwiched by the pair of aligning members 1 at a position greater than the length in the depth direction of the sheet S by a predetermined amount (A illustrated in FIG. 14A) to be aligned to be in a state illustrated in FIG. 14B (S806). After completing the alignment, the pair of aligning members 1 is moved to the above-described sheet receiving position (position illustrated in FIG. 14A) again to prepare for receiving a next sheet.

Figure 15:
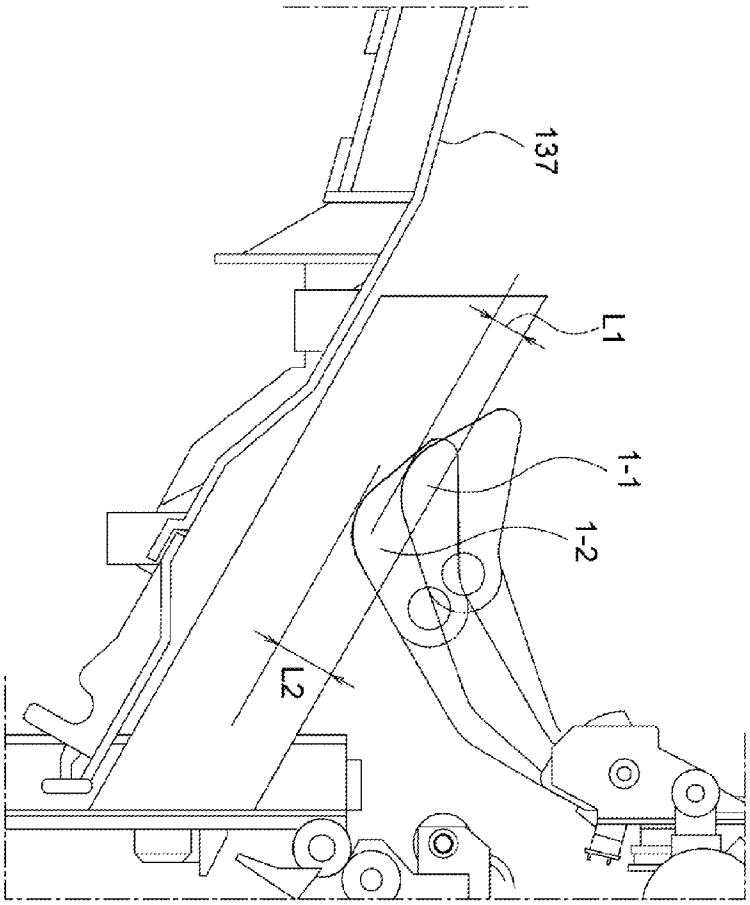
FIG. 15 is a partial cross-sectional view illustrating a positional relationship of the aligning member with respect to the stack tray.

After the sheet is stacked on the lower stack tray 137, it is confirmed whether or not the second detector 510*b* of the sheet stack height detecting portion 510 is turned ON state. If the second detector 510*b* is turned ON, the lower stack tray 137 is lowered until the second detector 510*b* is turned OFF. If the second detector 510*b* is turned OFF even after the stacking, the lower stack tray 137 stays at an original position to receive a next sheet. The above-described operations are performed on each sheet (S807, S808). As described above, operations of the discharge of the sheet and the lowering of the lower stack tray 137 are repeated such that a predetermined amount of the sheets is stacked as illustrated in FIG. 15 accompanying the movement of the lower stack tray 137 from the initial stack height to a position lowered by a predetermined amount (S809).

Here, as the encoder 520 and the tray position detection sensor S13 as stack amount detection portions detect that the lower stack tray 137 is moved downward the stack height direction by an amount equal to or larger than a predetermined amount, the aligning member lifting and lowering motor M11 rotates to rotate (lower) the pair of aligning members 1 (S810). That is, as the lower stack tray 137 is moved downward the sheet stack height direction by an amount equal to or larger than a predetermined amount, it is determined that the amount of the stacked sheet exceeds a predetermined stack amount. Accordingly, the pair of aligning members 1 are rotated downward the sheet stack height direction. Thereby, the pair of aligning members 1 follows the lowering of the lower stack tray 137 to be moved from a first aligning position (1-1 illustrated in FIG. 15) to a second aligning position (1-2 illustrated in FIG. 15). The first aligning position corresponds to an aligning position at which the sheet is aligned in a case where the lower stack tray 137 is not moved or is moved by an amount less than the predetermined amount. The second aligning position corresponds to an aligning position which is located lower that the above-described first aligning position.

As described above, as the pair of aligning members 1 follows the lowering of the lower stack tray 137 by an amount equal to or larger than the predetermined amount to be lowered, an overlapping amount L with respect to the top surface of the stacked sheet or the sheet bundle is larger than that prior to the lowering. FIG. 15 is a view in which the pair of aligning members 1 prior to the lowering is overlapped with respect to the pair of aligning members 1 after the lowering. Aligning members 1-1 correspond to the aligning members prior to the lowering (the first aligning position) and aligning members 1-2 correspond to the aligning members after the lowering (the second aligning position). As illustrated in FIG. 15, it can be understood that a relationship between an overlapping amount L1 and an overlapping amount L2 shows that L2>L1.

Even after the pair of aligning members 1 is lowered during the job, the alignment of the sheet in the width direction continues to discharge and align the sheet sequentially up to the final sheet. After completing the alignment of the final sheet, the pair of aligning members 1 and the tray paddles 40 are moved to the home positions to complete the job (S811, S812).

As described above, in the middle of the job, the pair of aligning members 1 is lowered when the lower stack tray 137 is lowered by an amount equal to or larger than the predetermined amount so that the overlapping amount L of the pair of aligning members 1 with respect to the top surface of the sheet or the sheet bundle is increased. That is, when the lower stack tray 137 is lowered by an amount equal to or larger than the predetermined amount, the pair of aligning members 1 is moved downward to prevent stroke of the aligning members with respect to the stacked sheet from being missed to ensure that the curled sheet can be aligned. Thereby, a likelihood of deterioration of the alignment of the sheet can be reduced so that the aligned sheet bundle can be supplied to the user.

To address the problems of the present invention, a method in which the overlapping amount L of the aligning members with respect to the stack tray in the initial stack state is preset larger may be considered. As the overlapping amount L is set larger, however, a recessed portion of the stack tray for overlapping should be formed larger. Accordingly, it is necessary to set the thickness of the whole stack tray larger as well. As a result, since space in the stack height is limited, the larger the overlapping amount L is set, the less the stack amount (the number of sheet) of the sheet becomes.

According to the present invention, it is not necessary to set the overlapping amount in the initial stack state larger for the curled sheet, the thickness of the stack tray can be regulated to minimum. As a result, stack space can be utilized as much as possible so that more of the stack amount (the number of the sheet) of the sheet on the stack tray can be secured, leading reduction of a cost for the stack tray.

Further, it may be considered that the height of the aligning members in the initial stack state is lowered to a position at which the aligning members abut the stack tray to gain the above-described overlapping amount. However, noise upon abutting the aligning members to the stack tray may be uncomfortable for the user. Accordingly, it is not an advantageous way. To prevent the noise from being generated, it is necessary to set a position at which lower ends of the aligning members stop higher than a bottom portion of the recessed portion of the stack tray by a predetermined amount. Accordingly, the overlapping amount L becomes smaller than the depth of the recessed portion of the stack tray. Further, upon lowering the aligning members, the aligning members are moved excessively to a direction approaching the stack tray rather than the stop position by impulse of the lowering. Accordingly, the stop position cannot be approached to the bottom portion of the recessed portion of the stack tray by an amount larger than the predetermined amount. That is, the overlapping amount L is reduced less than an amount of the depth of the recessed stack tray, leading reduction of the alignment by the above-described miss stroke.

According to the present invention, in the initial stack state, the aligning members can be avoided from abutting the stack tray so that crash noise can be also avoided.

The above-described lowering of the stack tray by a predetermined amount after the discharge of the sheet and accompanying lowering of the aligning members may be performed at once or performed in batches. For example, operations in that the lower stack tray is lowered by 5 mm and the aligning members are rotated by two degrees may be performed five times, namely, a plurality of times little by little, or operations in that the lower stack tray is lowered by 25 mm and the aligning members are rotated by ten degrees may be performed at once.

Further, in the above-described embodiment, the encoder 520 embedded in the lower stack tray 137 detects the height of the lower stack tray 137 so that the pair of aligning members 1 follows the lower stack tray 137 to change the height of the pair of aligning members 1. The embodiment, however, is not limited to such a configuration. For example, a counter as a stack amount detection portion which counts the number of sheet stacked on the lower stack tray 137 may be provided so that the height (movement amount downward the sheet stack height direction) of the pair of aligning members 1 may be controlled to be changed in accordance with the number (stack amount) of sheets stacked on the lower stack tray 137.

In the above-described embodiment, a configuration in which photoconductive drums configuring the image forming portion 604 are used for each color is exemplified. The number of the elements used, however, may be appropriately set according to needs.

Further, in the above-described embodiment, the copying machine is exemplified as the image forming apparatus, but the present invention is not limited thereto. Another image forming apparatus such as a printer and a facsimile apparatus or yet another image forming apparatus such as a combined machine that combines these functions may be used. Alternatively, an image forming apparatus may be configured such that an intermediate transfer member is used to transfer a toner image of each color thereon in a sequentially superimposed manner and transfer the toner image carried by the intermediate transfer member on a recording material at once. The same advantage can be obtained by applying the present invention to the sheet stacking apparatus in the image forming apparatus.

Further, in the above-described embodiment, the sheet stacking apparatus that can be attached to and removed from the image forming apparatus is exemplified, but the present invention is not limited thereto. For example, the image forming apparatus may integrally include the sheet stacking apparatus. The same advantage can be obtained by applying the present invention to the sheet stacking apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-102580, filed Apr. 27, 2012, and No. 2013-050303, filed Mar. 13, 2013, which are hereby incorporated by reference herein in their entirety.

What is claimed is:

1. A sheet stacking apparatus comprising:

a discharge portion which discharges a sheet;

a stacking portion including a stack tray on which the sheet discharged from the discharge portion is stacked and a sheet stack height detecting portion which detects a stack height of the sheets stacked on the stack tray, the stack tray being movably arranged in a sheet stack height direction so that a position of a top surface of the stacked sheets is maintained in accordance with a detection result obtained by the sheet stack height detecting portion;

a pair of aligning members which is provided above the stack tray to be lifted and lowered and which moves in a width direction perpendicular to a discharge direction of the sheet to sandwich and align the sheet stacked on the stack tray at a downstream area from the sheet stack height detecting portion in the discharge direction;

a stack amount detecting portion which detects a stack amount of the sheets stacked on the stack tray, the stack amount detecting portion configured to include a movement amount detector which detects a movement amount of the stack tray in the sheet stack height direction, and the stack amount detecting portion detects the stack amount of the sheets stacked on the stack tray according the movement amount of the stack tray in the sheet stack height direction, the movement amount being detected by the movement amount detector; and a controller which controls so as to move the pair of aligning members downwardly in the sheet stack height direction when the movement amount of the stack tray in the sheet stack height direction, which is detected by the movement amount detector, is equal to or larger than a predetermined amount.

2. The sheet stacking apparatus according to claim 1, wherein, when the stack tray is moved downwardly in the sheet stack height direction by the predetermined amount or more, the controller moves the pair of aligning members from a first aligning position at which the sheet is aligned when the movement amount of the stack tray in the sheet stack height direction does not exceed the predetermined amount to a second aligning position which is below the first aligning position.

3. The sheet stacking apparatus according to claim 1, wherein the controller performs a plurality of movements of the stack tray downward in the sheet stack height direction by the predetermined amount or more and a plurality of movements of the pair of aligning members downward in the sheet stack height direction according to the movement of the stack tray.

4. A sheet stacking apparatus comprising:

a discharge portion which discharges a sheet;

a stacking portion including a stack tray on which the sheet discharged from the discharge portion is stacked and a sheet stack height detecting portion which detects a stack height of the sheets stacked on the stack tray, the stack tray being movably arranged in a sheet stack height direction so that a position of a top surface of the stacked sheets is maintained in accordance with a detection result obtained by the sheet stack height detecting portion;

a pair of aligning members which is provided above the stack tray to be lifted and lowered and which moves in a width direction perpendicular to a discharge direction of the sheet to sandwich and align the sheet stacked on the stack tray at a downstream area from the sheet stack height detecting portion in the discharge direction;

a counter which counts the number of the sheets stacked on the stack tray; and a controller which controls so as to move the pair of aligning members downwardly in the sheet stack height direction when the number of the sheets counted by the counter is equal to or larger than a predetermined amount.

5. An image forming apparatus comprising:

an image forming portion which forms an image on a sheet; and a sheet stacking apparatus which stacks the sheet on which the image is formed by the image forming portion, wherein the sheet stacking apparatus includes:

a discharge portion which discharges the sheet;

a stacking portion including a stack tray on which the sheet discharged from the discharge portion is stacked and a sheet stack height detecting portion which detects a stack height of the sheets stacked on the stack tray, the stack tray being movably arranged in a sheet stack height direction so that a position of a top surface of the stacked sheets is maintained in accordance with a detection result obtained by the sheet stack height detecting portion;

a pair of aligning members which is provided above the stack tray to be lifted and lowered and which moves in a width direction perpendicular to a discharge direction of the sheet to sandwich and align the sheet stacked on the stack tray at a downstream area from the sheet stack height detecting portion in the discharge direction;

a stack amount detecting portion which detects a stack amount of the sheets stacked on the stack tray, the stack amount detecting portion configured to include a movement amount detector which detects a movement amount of the stack tray in the sheet stack height direction, and the stack amount detecting portion detects the stack amount of the sheets stacked on the stack tray according the movement amount of the stack tray in the sheet stack height direction, the movement amount being detected by the movement amount detector; and a controller which controls so as to move the pair of aligning members downwardly in the sheet stack height direction when the movement amount of the stack tray in the sheet stack height direction, which is detected by the movement amount detector, is equal to or larger than a predetermined amount.

6. The image forming apparatus according to claim 5, wherein, when the stack tray is moved downwardly in the sheet stack height direction by the predetermined amount or more, the controller moves the pair of aligning members from a first aligning position at which the sheet is aligned when the movement amount of the stack tray in the sheet stack height direction does not exceed the predetermined amount to a second aligning position which is below the first aligning position.

7. The image forming apparatus according to claim 5, wherein the controller performs a plurality of movements of the stack tray downward in the sheet stack height direction by the predetermined amount or more and a plurality of movements of the pair of aligning members downward in the sheet stack height direction according to the movement of the stack tray.

8. An image forming apparatus comprising:

an image forming portion which forms an image on a sheet; and a sheet stacking apparatus which stacks the sheet on which the image is formed by the image forming portion, wherein the sheet stacking apparatus includes:

a discharge portion which discharges the sheet;

a stacking portion including a stack tray on which the sheet discharged from the discharge portion is stacked and a sheet stack height detecting portion which detects a stack height of the sheets stacked on the stack tray, the stack tray being movably arranged in a sheet stack height direction so that a position of a top surface of the stacked sheets is maintained in accordance with a detection result obtained by the sheet stack height detecting portion;

a pair of aligning members which is provided above the stack tray to be lifted and lowered and which moves in a width direction perpendicular to a discharge direction of the sheet to sandwich and align the sheet stacked on the stack tray at a downstream area from the sheet stack height detecting portion in the discharge direction;

a counter which counts the number of the sheets stacked on the stack tray; and a controller which controls so as to move the pair of aligning members downwardly in the sheet stack height direction when the number of the sheets counted by the counter is equal to or larger than a predetermined amount.

9. A sheet stacking apparatus comprising:

a discharge portion which discharges a sheet;

a stacking portion including a stack tray on which the sheet discharged from the discharge portion is stacked and a sheet stack height detecting portion which detects a stack height of the sheets stacked on the stack tray, the stack tray being movably arranged in a sheet stack height direction so that a position of a top surface of the stacked sheets is maintained in accordance with a detection result obtained by the sheet stack height detecting portion;

a pair of aligning members which is provided above the stack tray and which moves in a width direction perpendicular to a discharge direction of the sheet to sandwich and align the sheet stacked on the stack tray;

a stack tray position detecting portion which detects information regarding the height of the stack tray in a sheet stacking height direction: and a controller which controls so as to change an aligning position where the pair of aligning members align the sheets stacked on the stack tray to move downward from a first aligning position to a second aligning position lower than the first aligning position in a case that the controller decides the stack tray moves downward from a first tray position to a second tray position lower than the first tray position according to the information detected by the stack tray position detecting portion.

10. A sheet stacking apparatus according to claim 9, the controller controls so as to measure a moving distance of the stack tray according to the information detected by the stack tray position detecting portion and decides that the stack tray moved downward from the first tray position to the second tray position by the moving distance of the stack tray.

11. A sheet stacking apparatus according to claim 10, the stack tray position detecting portion has an encoder and the moving distance of the stack tray is measured by the encoder.

12. A sheet stacking apparatus comprising:

a discharge portion which discharges a sheet;

a stacking portion including a stack tray on which the sheet discharged from the discharge portion is stacked and a sheet stack height detecting portion which detects a stack height of the sheets stacked on the stack tray, the stack tray being movably arranged in a sheet stack height direction so that a position of a top surface of the stacked sheets is maintained in accordance with a detection result obtained by the sheet stack height detecting portion;

a pair of aligning members which is provided above the stack tray and which moves in a width direction perpendicular to a discharge direction of the sheet to sandwich and align the sheet stacked on the stack tray;

a sheet stack amount detecting portion which detects information regarding amount of the sheets on the stack tray; and a controller which controls so as to change an aligning position where the pair of aligning members align the sheets stacked on the stack tray to move downward from a first aligning position to a second aligning position lower than the first aligning position in a case that the controller decides the stack tray moves downward from a first tray position to a second tray position lower than the first tray position according to the information detected by the sheet stack amount detecting portion.

13. A sheet stacking apparatus according to claim 12, the sheet stack amount detecting portion is a counter which counts a number of the sheets stacked on the stack tray.

14. An image forming apparatus comprising:

an image forming portion which forms an image on a sheet; and a sheet stacking apparatus which stacks the sheet on which the image is formed by the image forming portion, wherein the sheet stacking apparatus includes:

a discharge portion which discharges the sheet;

a stacking portion including a stack tray on which the sheet discharged from the discharge portion is stacked and a sheet stack height detecting portion which detects a stack height of the sheets stacked on the stack tray, the stack tray being movably arranged in a sheet stack height direction so that a position of a top surface of the stacked sheets is maintained in accordance with a detection result obtained by the sheet stack height detecting portion;

a pair of aligning members which is provided above the stack tray to be lifted and lowered and which moves in a width direction perpendicular to a discharge direction of the sheet to sandwich and align the sheet stacked on the stack tray;

a stack tray position detecting portion which detects information regarding an amount of sheets on the stack tray in a sheet stacking height direction: and a controller which controls so as to change an aligning position where the pair of aligning members align the sheets stacked on the stack tray to move downward from a first aligning position to a second aligning position lower than the first aligning position in a case that the controller decides the stack tray moves downward from a first tray position to a second tray position lower than the first tray position according to the information detected by the stack tray position detecting portion.

15. An image forming apparatus according to claim 14, the controller measures moving distance of the stack tray according to the information detected by the stack tray portion detecting portion and decided that the stack tray moved downward from the first tray position to the second tray position by the moving distance of the stack tray.

16. An image forming apparatus according to claim 15, the stack tray position detecting portion has an encoder and the moving distance of the stack tray is measured by the encoder.

17. An image forming apparatus comprising:

an image forming portion which forms an image on a sheet; and a sheet stacking apparatus which stacks the sheet on which the image is formed by the image forming portion, wherein the sheet stacking apparatus includes:

a discharge portion which discharges the sheet;

a stacking portion including a stack tray on which the sheet discharged from the discharge portion is stacked and a sheet stack height detecting portion which detects a stack height of the sheets stacked on the stack tray, the stack tray being movably arranged in a sheet stack height direction so that a position of a top surface of the stacked sheets is maintained in accordance with a detection result obtained by the sheet stack height detecting portion;

a pair of aligning members which is provided above the stack tray to be lifted and lowered and which moves in a width direction perpendicular to a discharge direction of the sheet to sandwich and align the sheet stacked on the stack tray;

a sheet stack amount detecting portion which detects information regarding an amount of the sheets on the stack tray; and a controller which controls so as to change an aligning position where the pair of aligning members align the sheets stacked on the stack tray to move downward from a first aligning position to a second aligning position lower than the first aligning position in a case that the controller decides the stack tray moves downward from a first tray position to a second tray position lower than the first tray position according to the information detected by the sheet stack height detecting portion.

18. An image forming apparatus according to claim 17, wherein the sheet stack amount detecting portion is a counter which counts number of the sheets stacked on the stack tray.

* * * * *